United States Patent [19]

Ikegawa et al.

[11] Patent Number: 4,970,141

[45] **Date of Patent: * Nov. 13, 1990**

[54] SILVER HALIDE PHOTOGRAPHIC EMULSION

[75] Inventors: Akihiko Ikegawa; Masaki Okazaki; Yuichi Ohashi, all of Minami-Ashigara, Japan

[73] Assignee: Fuji Photo Film Co., Ltd., Kanagawa, Japan

[ * ] Notice: The portion of the term of this patent subsequent to Jul. 4, 2006 has been disclaimed.

[21] Appl. No.: 154,555

[22] Filed: Feb. 10, 1988

[30] Foreign Application Priority Data

Feb. 12, 1987 [JP] Japan ..... 62-030414

[51] Int. Cl.[5] ..... G03C 1/29; G03C 1/18

[52] U.S. Cl. ..... 430/550; 430/574; 430/585; 430/588

[58] Field of Search ..... 430/574, 550, 585, 588

[56] References Cited

U.S. PATENT DOCUMENTS

| | | | |
|---|---|---|---|
| 3,580,723 | 5/1971 | Sato et al. | 430/550 |
| 3,864,134 | 2/1975 | Ueda et al. . | |
| 4,362,813 | 12/1982 | Mihara et al. | 430/574 |
| 4,551,424 | 11/1985 | Ikeda et al. | 430/588 |
| 4,571,380 | 2/1986 | Noguchi et al. | 430/589 |

FOREIGN PATENT DOCUMENTS 44-32753 12/1969 Japan .

*Primary Examiner*—Paul R. Michl
*Assistant Examiner*—Mark R. Buscher
*Attorney, Agent, or Firm*—Sughrue, Mion, Zinn, Macpeak & Seas

[57] ABSTRACT

A silver halide photographic emulsion containing at least one of the compounds of formula (I) and at least one of the compounds of formula (III), or further containing at least one of the compounds of formula (II) besides the above at least two compounds:

General formula (I)

General formula (II)

General formula (III)

wherein $R_0$, $R_1$, $R_2$, $R_3$, $R_4$, $R_5$, $R_6$, $R_7$, $R_8$, $R_9$, $R_{10}$ and $R_{11}$ each represent various groups; $X_1\ominus$, $X_2\ominus$ and $X_3\ominus$ each represent counter anions; l, m and n are each 0 or 1; $Z_1$ and $Z_2$ each represent nonmetal atomic groups necessary for forming unsubstituted or substituted benzene rings, or unsubstituted or substituted naphthalene rings; and $Z_3$ and $Z_4$ each represent nonmetal atomic groups necessary for forming unsubstituted or substituted naphthalene rings.

The silver halide photographic emulsions are enhanced in spectral light-sensitivity of green wavelength region, and photographic light-sensitive materials prepared using these emulsions are not only enhanced in spectral sensitivity of green short wavelength region, but also excellent in inhibiting fog increase and sensitivity lowering during preservation.

19 Claims, No Drawings

SILVER HALIDE PHOTOGRAPHIC EMULSION

BACKGROUND OF THE INVENTION

1. Field of the Invention

This invention relates to a silver halide photographic emulsion, and particularly relates to a silver halide photographic emulsion having an elevated spectral sensitivity in green wavelength region. More specifically, the present invention relates to a silver halide photographic emulsion which leads to photographic light-sensitive materials having an elevated spectral sensitivities in green short wavelength region and excellent storage stabilities.

2. Description of the Prior Art

As silver halide photographic emulsions having an elevated spectral sensitivity in a green wavelength region, silver halide photographic emulsions wherein an oxacarbocyanine dye and an imidacarbocyanine dye are used together (for example, Japanese Patent Unexamined Published Application (hereinafter referred to as "J. P. KOKAI") Nos. 59-116646, 59-116647, 59-140443, 59-149346 and the like), those wherein an oxacarbocyanine dye and an oxathiacarbocyanine dye are used together (for example, Japanese Patent Publication for Opposition Purpose (hereinafter referred to as "J. P. KOKOKU") No. 46-11627, J. P. KOKAI No. 60-42750 and the like), those wherein 2 or more oxacarbocyanine dyes are used together (for example, J. P. KOKAI No. 52-23931 and the like), and the like have hitherto been known. However, any of those photographic emulsion has only a low spectral sensitivity in a green short wavelength region, which resulted in a problem on color reproduction.

On the other hand, as sensitizing dyes having a maximal valve of spectral sensitivity between 520 nm and 545 nm, benzimidazolooxazolocarbocyanine dyes (for example, compounds disclosed in J. P. KOKOKU No. 44-14030 and the like) and dimethynemerocyanine dyes (for example, compounds disclosed in U.S. Pat. Nos. 2,493,748, 2,519,001 and 3,480,439 and the like) have hitherto been known. Thus, to solve the above problem, using together a further sensitizing dye having a maximal value of spectral sensitivity between 520 nm and 545 nm may be thought of. However, in emulsions containing a benzimidazolooxazolocarbocyanine or a dimethynemerocyanine, increase of fog owing to a high temperature or a condition of high temperature and high humidity after application of the emulsion, or lowering of sensitivity owing to poorness of stability with time lapse after application of the emulsions is observed. Thus, such a dye does not seem to be suitable for using together.

Under the above circumstances, development of a photographic emulsion which is free from the above drawbacks and has a maximal value of spectral sensitivity in a green short wavelength region, and wherein a new sensitizing dye is used has been desired.

SUMMARY OF THE INVENTION

The present invention relates to spectral sensitization of a silver halide photographic emulsion, and the first object of the present invention is to provide a silver halide photographic emulsion having an elevated spectral sensitivity in a green wavelength region.

The second object of the present invention is to provide photographic light-sensitive materials which have elevated spectral sensitivities in a green short wavelength region and are excellent in storage stability.

The above objects of the present invention have been accomplished by a silver halide photographic emulsion which contains at least one of the compounds represented by the following general formula (I), and at least one of the compounds represented by the following general formula (III):

General formula (I)

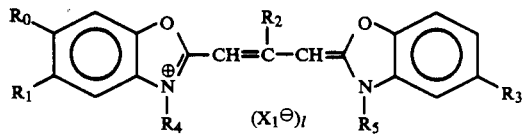

wherein $R_0$ and $R_1$ may be the same or different, and represent hydrogen atoms, alkyl groups, aryl groups, alkoxy groups, aryloxy groups, halogen atoms, alkoxycarbonyl groups, acylamino groups, acyl groups, cyano groups, carbamoyl groups, sulfamoyl groups, carboxyl groups or acyloxy groups, provided that $R_0$ and $R_1$ do not represent hydrogen atoms at the same time; $R_2$ represents a hydrogen atom, or an alkyl or aryl group; $R_3$ represents an alkyl group having 2 or more carbon atoms, an aryl group, an alkoxy group having 2 or more carbon atoms, an aryloxy group, an acyl group having 3 or more carbon atoms, an acyloxy group having 3 or more carbon atoms, an alkoxycarbonyl group having 4 or more carbon atoms, or an acylamino group having 3 or more carbon atoms, and moreover $R_3$ is required to be a substituent having such L and B that S value is 544 or less in the equation of $$S=3.536L-2.661B+535.4$$

wherein L represents a STERIMOL parameter (its unit is Å) disclosed in A. Verloop, W. Hoogenstraaten, J. Tipker; "Drug Design, Vol VII", (E. J. Ariens Ed.) Academic Press, New York (1976), pp. 180–185 and the like, and B represents the smaller value among $B_1+B_4$ and $B_2+B_3$ which are each sums of STERIMOL parameters, provided that $R_1$ and $R_3$, or $R_0$ and $R_3$ do not represent aryl groups at the same time; $R_4$ and $R_5$ may be the same or different, and represent alkyl groups; $X_1\ominus$ represents a counter anion; and l is 0 or 1, and when an innert salt is formed, l is 0;

General formula (III)

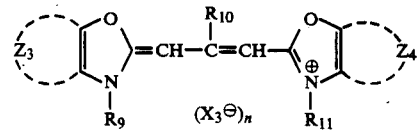

wherein $Z_3$ and $Z_4$ may be the same or different, and represent nonmetal atomic groups necessary for formation of naphthalene rings; $R_9$ and $R_{11}$ *have the same meanings with* $R_4$ and $R_5$, $R_{10}$ has the same meaning with $R_2$; $X_3\ominus$ has the same meaning with $X_1\ominus$; and n has the same meaning with l.

DETAILED DESCRIPTION OF THE INVENTION

In the general formula (I), the alkyl groups in the definition of $R_0$ and $R_1$ may each be substituted with substituent(s), and preferably include alkyl groups each having 10 or less carbon atoms, for example methyl, ethyl, propyl, isopropyl, butyl, branched butyl (e.g. isobutyl or t-butyl groups), pentyl, branched pentyl (e.g. isopentyl or t-pentyl groups), vinylmethyl, cyclohexyl, benzyl, phenethyl, 3-phenylpropyl or trifluoromethyl groups or the like.

The aryl groups in the definition of $R_0$ and $R_1$ may each be substituted with substituent(s), and preferably include aryl groups each having 10 or less carbon atoms, for example phenyl, 4-methylphenyl, 4-chlorophenyl or naphthyl groups or the like.

The alkoxy groups in the definition of $R_0$ and $R_1$ may each be substituted with substituent(s), and preferably include alkoxy groups each having 10 or less carbon atoms, for example methoxy, ethoxy, propyloxy, butyloxy, pentyloxy, benzyloxy or phenethyloxy groups or the like.

The aryloxy groups in the definition of $R_0$ and $R_1$ may each be substituted with substituent(s), and preferably include aryloxy groups each having 10 or less carbon atoms, for example phenoxy, 4-methylphenoxy, 4-chlorophenoxy or naphthyloxy groups or the like.

Halogen atoms in the definition of $R_0$ and $R_1$ and fluorine, chlorine, bromine or iodine atoms.

The alkoxycarbonyl groups in the definition of $R_0$ and $R_1$ may each be substituted with substituent(s), and preferably include alkoxycarbonyl groups each having 10 or less carbon atoms, for example methoxycarbonyl, ethoxycarbonyl or benzyloxycarbonyl groups or the like.

The acylamino groups in the definition of $R_0$ and $R_1$ may each be substituted with substiuent(s) and preferabley include acylamino groups each having 8 or less carbon atoms, for example acetylamino, trifluoroacetylamino, propionylamino or benzoylamino groups or the like.

The acyl groups in the definition of $R_0$ and $R_1$ may each be substituted with substituent(s), and preferably include acyl groups each having 10 or less carbon atoms, for example acetyl, trifluoroacetyl, propionyl, benzoyl, p-chlorobenzoyl or mesyl groups or the like.

The carbamoyl groups in the definition of $R_0$ and $R_1$ may each be substituted with substituent(s), and preferably include carbamoyl groups each having 6 or less carbon atoms, for example carbamoyl, N,N-dimethylcarbamoyl or morpholinocarbonyl groups or the like.

The sulfamoyl groups in the definition of $R_0$ and $R_1$ may each be substituted with substituent(s), and preferably include sulfamoyl groups having 6 or less carbon atoms, for example sulfamoyl, N,N-dimethylsulfamoyl, morpholinosulfonyl or piperidinosulfonyl groups or the like.

The acyloxy groups in the definition of $R_0$ and $R_1$ may each be substituted with substituent(s), and preferably include acyloxy groups each having 10 or less carbon atoms, for example acetyloxy, trifluoroacetyloxy, propionyloxy or benzoyloxy groups or the like.

Besides the above definition, $R_0$ and $R_1$ may further be hydrogen atoms, cyano groups or carboxyl groups, provided that $R_0$ and $R_1$ do not represent hydrogen atoms at the same time. In most preferred combination of $R_0$ and $R_1$, $R_0$ is a phenyl group substituted at the 5-position and $R_1$ is a hydrogen atom.

The alkyl and aryl groups in the definition of $R_2$ may each be substituted with substituent(s), and preferably include an alkyl group having 4 or less carbon atoms (for example, a methyl, ethyl, propyl, butyl, benzyl, phenethyl or 3-phenylpropyl group or the like) and an aryl group having 10 or less carbon atoms (for example, a phenyl or p-tolyl group or the like). $R_2$ may also be a hydrogen atom.

The alkyl, aryl, alkoxy, aryloxy, acyl, acyloxy, alkoxycarbonyl and acylamino groups in the definition of $R_3$ may each be substituted with substituent(s), provided that $R_1$ and $R_3$ do not represent aryl groups at the same time.

Examples of preferred $R_3$ group include ethyl, propyl, isopropyl, branched butyl (e.g., t-butyl, etc.), branched pentyl (e.g., isopentyl, t-pentyl, etc.), branched hexyl (e.g., 3,3-dimethylbutyl, etc.), cyclohexyl, branched octyl (e.g., t-octyl), benzyl, phenethyl and t-butylcarbonyloxy groups and the like. Most preferred examples of $R_3$ include ethyl, propyl, isopropyl, t-butyl, t-pentyl, cyclohexyl, t-octyl and benzyl groups.

The alkyl groups in the definition of $R_4$ and $R_5$ may each be substituted with substituent(s), and preferably include alkyl groups each having 8 or less carbon atoms (for example, methyl, ethyl, propyl, vinylmethyl, butyl, pentyl, hexyl, heptyl or octyl groups or the like); aralkyl groups each having 10 or less carbon atoms (for example, benzyl, phenethyl or 3-phenylpropyl groups or the like); or alkyl groups each having 6 or less carbon atoms each substituted with a substituent selected from the group consisting of a hydroxyl group, a carboxyl group, a sulfo or a cyano group, a halogen atom (e.g., a fluorine, chlorine or bromine atom or the like), an unsubstituted or substituted alkoxycarbonyl group having 8 or less carbon atoms (e.g., a methoxycarbonyl, ethoxycarbonyl, benzyloxycarbonyl group or the like), an unsubstituted or substituted alkoxy group having 8 or less carbon atoms (e.g., a methoxy, ethoxy, butyloxy, benzyloxy or phenethyloxy group or the like), an aryloxy group having 8 or less carbon atoms (e.g., a phenoxy or p-tolyloxy group or the like), an acyloxy group having 8 or less carbon atoms (e.g., an acetyloxy, propionyloxy or benzoyloxy group or the like), an acyl group having 8 or less carbon atoms (e.g. an acetyl, propionyl, benzoyl or 4-fluorobenzoyl group or the like), an unsubstituted or substituted carbamoyl group having 6 or less carbon atoms (e.g., a carbamoyl, N,N-dimethylcarbamoyl, morpholinocarbonyl or piperidinocarbonyl or the like), an unsubstituted or substituted sulfamoyl group having 6 or less carbon atoms (e.g., a sulfamoyl, N,N-dimethylsulfamoyl, morpholinosulfonyl or piperidinosulfonyl group or the like), and an unsubstituted or substituted aryl group having 10 or less carbon atoms (e.g., a phenyl, p-fluorophenyl, p-hydroxyphenyl, p-carboxyphenyl or p-sulfophenyl group or the like).

One of $R_4$ and $R_5$ is preferable to be a sulfoalkyl group or a carboxyalkyl group.

$X_1\ominus$ represents an inorganic or organic acid anion, for example chloride, bromide, iodide, p-toluenesulfonate, p-nitrobenzenesulfonate, methanesulfonate, methylsulfate, ethylsulfate, perchlorate or the like.

In the general formula (III), each naphthalene ring formed containing $Z_3$ or $Z_4$ may be substituted by a substituent. Examples of a heterocyclic part formed including $Z_3$ or $Z_4$ as expressed as a naphthooxazole include naphtho(1,2-d)oxazole, naphtho(2,1-d)oxazole, naphtho(2,3-d)oxazole, 8-methoxynaphtho(1,2-d)oxazole, 5-acetylaminonaphtho(2,1-d)oxazole, etc.

According to a preferred embodiment of the present invention, the silver halide emulsion of the present invention further contains at least one of the compounds represented by the following general formula (II):

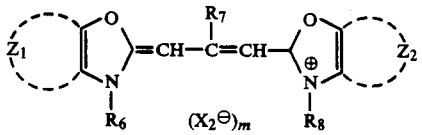

wherein $Z_1$ and $Z_2$ may be the same or different, and represent nonmetal atomic groups necessary for formation of benzene rings or naphthalene rings, provided that $Z_1$ and $Z_2$ are not used for formation of naphthalene rings at the same time, and further provided that when $Z_1$ and/or $Z_2$ form benzene rings each having a substituent, the substituent does not represent any of substituents defined as $R_3$; $R_7$ has the same meaning with $R_2$; $R_6$ and $R_8$ have the same meanings with $R_4$ and $R_5$, respectively; $X_2\ominus$ has the same meaning with $X_1\ominus$; and m has the same meaning with l.

Benzene ring or naphthalene ring formed containing $Z_1$ or $Z_2$ may be substituted with substituent(s). Examples of a heterocyclic part formed containing $Z_1$ or $Z_2$ as expressed as a benzoxazole or naphthooxazole include, for example, benzoxazole, 5-chlorobenzoxazole, 5-methylbenzoxazole, 5-bromobenzoxazole, 5-fluorobenzoxazole, 5-phenylbenzoxazole, 5-methoxybenzoxazole, 5-butoxybenzoxazole, 5-nitrobenzoxazole, 5-trifluoromethylbenzoxazole, 5-hydroxybenzoxazole, 5-carboxybenzoxazole, 6-methylbenzoxazole, 6-chlorobenzoxazole, 6-nitrobenzoxazole, 6-methoxybenzoxazole, 6-amylbenzoxazole, 6-hydroxybenzoxazole, 5,6-dimethylbenzoxazole, 4,6-dimethylbenzoxazole, 5-ethoxybenzoxazole, naphtho(2,1-d)oxazole, naphtho(1,2-d)oxazole, naphtho(2,3-d)oxazole, 5-nitronaphtho(2,1-d)oxazole, and the like.

Most preferred examples of a heterocyclic part formed containing $Z_1$ or $Z_2$ as expressed as a benzoxazole or naphthooxazole include 5-chlorobenzoxazole, 5-bromobenzoxazole, 5-fluorobenzoxazole, 5-phenylbenzoxazole, 5-methoxybenzoxazole, 5,6-dimethylbenzoxazole, naphtho(2,1-d)oxazole, naphtho(1,2-d)oxazole, naphtho(2,3-d)oxazole and the like.

$R_6$ and $R_8$ have the same meaning with $R_4$ and $R_5$, and $R_7$ has the same meaning with $R_2$. The most preferred example of $R_7$ is an ethyl group. $X_2\ominus$ has the same meaning with $X_1\ominus$, and m has the same meaning with l.

Typical examples of the compounds used in the present invention as represented by the above general formulae (I) to (III) are illustrated below, but the scope of the present invention should not be interpreted as limited only to these compounds.

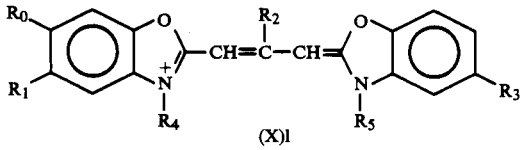

(X)l

| | $R_0$ | $R_1$ | $R_2$ | $R_3$ | $R_4$ | $R_5$ | X | l |
|---|---|---|---|---|---|---|---|---|
| I-1 | H |  | H | $(CH_2)_2CH_3$ | $(CH_2)_4$ $SO_3^-$ | $(CH_2)_4$ $SO_3H.N(C_2H_5)_3$ | — | 0 |
| I-2 | H | 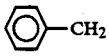 | $CH_3$ | $C_2H_5$ | $(CH_2)_4$ $SO_3^-$ | $C_2H_5$ | — | 0 |
| I-3 | H | 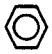 | $C_2H_5$ | $CH_3$ $C-CH_3$ $CH_3$ | $(CH_2)_2$ $SO_3^-$ | $(CH_2)_4$ $SO_3H$ | — | 0 |
| I-4 | H | 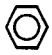 | $CH_3$ | $CH_3$ $C-C_2H_5$ $CH_3$ | $(CH_2)_2$ $SO_3^-$ | $(CH_2)_4$ $SO_3Na$ | — | 0 |
| I-5 | H | $C_2H_5-C(CH_3)_2$ | $C_2H_5$ | $CH_3$ $C-CH_3$ $CH_3$ | $(CH_2)_3$ $SO_3^-$ | $(CH_2)_3$ $SO_3K$ | — | 0 |
| I-6 | H | 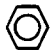 | $C_2H_5$ | 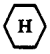 | $(CH_2)_2$ $SO_3^-$ | $(CH_2)_3$ $SO_3H.N(C_2H_5)_3$ | — | 0 |
| I-7 | H | 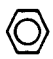 | $C_2H_5$ | $CH_3$ $C-C_2H_5$ $CH_3$ | $(CH_2)_2$ $SO_3^-$ | $(CH_2)_4$ $SO_3Na$ | — | 0 |
| I-8 | H | Cl | $CH_3$ | 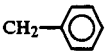 | $(CH_2)_3$ $SO_3^-$ | $(CH_2)_3$ $SO_3H.N(C_2H_5)_3$ | — | 0 |

-continued

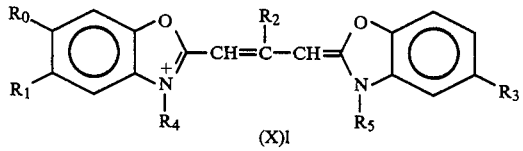

(X)l

| | $R_0$ | $R_1$ | $R_2$ | $R_3$ | $R_4$ | $R_5$ | X | l |
|---|---|---|---|---|---|---|---|---|
| I-9 | H | $CH_3$ | $C_2H_5$ | $CH_2$—⬡ | $C_2H_5$ | $C_2H_5$ | $CH_3$—⬡—$SO_3^-$ | 1 |
| I-10 | H | $(CH_3)_2NSO_2$ | $(CH_2)_2CH_3$ | $CH(CH_3)_2$ | $C_2H_5$ | $(CH_2)_3$—$SO_3^-$ | — | 0 |
| I-11 | ⬡—O | H | $C_2H_5$ | $CH_3$—C(CH$_3$)—$CH_3$ | $(CH_2)_4$—$SO_3^-$ | $(CH_2)_4$—$SO_3H.N(C_2H_5)_3$ | — | 0 |
| I-12 | $CH_3(CH_2)_4O$ | H | $CH_2$—⬡ | $CH_2CH_2$—⬡ | $(CH_2)_4$—$SO_3^-$ | $(CH_2)_2$—$SO_3Na$ | — | 0 |
| I-13 | HOOC | H | $C_2H_5$ | $OCOC(CH_3)_2$—$CH_3$ | $(CH_2)_3$—$SO_3^-$ | $C_2H_5$ | — | 0 |
| I-14 | $CH_3$, $CH_3$ NCO | H | H | $CH_2CH_2$—C($CH_3$)$_2$—$CH_3$ | $(CH_2)_4$—$SO_3^-$ | $CH_3$ | — | 0 |
| I-15 | H | ⬡ | $C_2H_5$ | $CH_3$—C($CH_3$)—$C_2H_5$ | $C_2H_5$ | $C_2H_5$ | $Br^-$ | 1 |
| I-16 | $CH_3O$ | H | $CH_3$ | $CH_2$—⬡ | $CH_3$ | $(CH_2)_3$—$SO_3^-$ | — | 0 |
| I-17 | Cl | H | H | ⬡(H) | $(CH_2)_3$—$SO_3^-$ | $(CH_2)_4$—$SO_3K$ | — | 0 |
| I-18 | H | ⬡ | $C_2H_5$ | $CH_3$—C($CH_3$)—$CH_2$—C($CH_3$)—$CH_3$ | $(CH_2)_2$—$SO_3^-$ | $(CH_2)_4$—$SO_3Na$ | — | 0 |
| I-19 | H | ⬡ | $C_2H_5$ | $CH_2$—⬡ | $(CH_2)_2$—$SO_3^-$ | $(CH_2)_4$—$SO_3H$ | — | 0 |
| I-20 | $CH_3$ | $CH_3$ | $C_2H_5$ | $CH_3$—C($CH_3$)—$C_2H_5$ | $(CH_2)_3$—$SO_3^-$ | $(CH_2)_3$—$SO_3Na$ | — | 0 |

Each L and B values of various substituents $R_3$ and S value calculated from the equation:

$$S=3.536L-2.661B+535.4$$

are exhibited in the following table.

| Substituent $R_3$ | L(Å) | B(Å) | S |
|---|---|---|---|
| $-C_2H_5$ | 4.11 | 3.80 | 540 |
| $-C_3H_7^{(n)}$ | 5.05 | 3.80 | 543 |
| $-C_3H_7^{(i)}$ | 4.11 | 5.20 | 536 |

-continued

| Substituent $R_3$ | L(Å) | B(Å) | S |
|---|---|---|---|
| $-C_4H_9^{(t)}$ | 4.11 | 5.56 | 535 |
| $-C_5H_{11}^{(t)}$ | 5.05 | 5.72 | 538 |
| $-C_2H_4C(CH_3)_3$ | 6.17 | 5.56 | 542 |
| $-CH_2C_6H_5$ | 3.63 | 6.22 | 533 |
| $-C_6H_{11}^{(cyclo)}$ | 6.17 | 5.53 | 543 |
| $-C_2H_4C_6H_5$ | 4.63 | 6.22 | 535 |
| $-OCOC(CH_3)_3$ | 5.96 | 5.56 | 542 |
| $-C_8H_{17}^{(i)}$ | 6.00 | 5.72 | 541 |

-continued

| Substituent $R_3$ | L(Å) | B(Å) | S |
|---|---|---|---|
| $-C_6H_5$ | 6.28 | 3.40 | 549 |

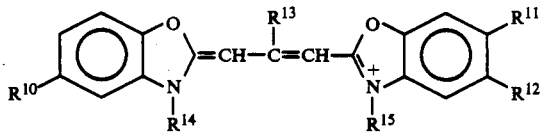

| | $R^{10}$ | $R^{11}$ | $R^{12}$ | $R^{13}$ | $R^{14}$ | $R^{15}$ |
|---|---|---|---|---|---|---|
| II-1 | | H | | $C_2H_5$ | $(CH_2)_2SO_3^-$ | $(CH_2)_2SO_3HN$ |
| II-2 | | H | Cl | $C_2H_5$ | $(CH_2)_2SO_3^-$ | $(CH_2)_3SO_3H.N(C_2H_5)_3$ |
| II-3 | Cl | H | Cl | $C_2H_5$ | $(CH_2)_3SO_3^-$ | $(CH_2)_3SO_3Na$ |
| II-4 | $OCH_3$ | H | $OCH_3$ | $C_2H_5$ | $(CH_2)_3SO_3^-$ | $(CH_2)_3SO_3K$ |
| II-5 | | H | $O(CH_2)_3CH_3$ | $C_2H_5$ | $(CH_2)_3SO_3^-$ | $(CH_2)_3SO_3K$ |
| II-6 | $OCH_3$ | H | $OCH_3$ | $CH_3$ | $(CH_2)_3SO_3^-$ | $(CH_2)_3SO_3Na$ |
| II-7 | Cl | H | Cl | H | $(CH_2)_4SO_3^-$ | $(CH_2)_4SO_3Na$ |
| II-8 | | H | | $CH_2-$ | $(CH_2)_3SO_3^-$ | $(CH_2)_3SO_3H$ |
| II-9 | | H | Cl | $C_2H_5$ | $(CH_2)_2SO_3^-$ | $C_2H_5$ |
| II-10 | | H | | $C_2H_5$ | $(CH_2)_2SO_3^-$ | $CH_3$ |
| II-11 | | H | $nC_4H_9$ | $C_2H_5$ | $(CH_2)_2SO_3^-$ | $(CH_2)_2SO_3Na$ |
| II-12 | $nC_4H_9$ | H | $OC_4H_9(n)$ | $C_2H_5$ | $(CH_2)_3SO_3^-$ | $(CH_2)_3SO_3K$ |
| II-13 | $CH_3$ | H | $CH_3$ | H | $(CH_2)_3SO_3^-$ | $(CH_2)_3SO_3K$ |
| II-14 | | $OC_5H_{11}(n)$ | H | $C_2H_5$ | $(CH_2)_3SO_3^-$ | $(CH_2)_4SO_3H$ |
| II-15 | $OC_4H_9(n)$ | H | $OC_4H_9(n)$ | H | $(CH_2)_4SO_3^-$ | $(CH_2)_4SO_3H$ |
| II-16 | $OC_7H_{15}(n)$ | H | $OC_7H_{15}(n)$ | $CH_3$ | $(CH_2)_3SO_3^-$ | $(CH_2)_3SO_3H.N(C_2H_5)_3$ |
| II-17 | | H | | $C_2H_5$ | $(CH_2)_4SO_3^-$ | $(CH_2)_4SO_3Na$ |

-continued

II-18

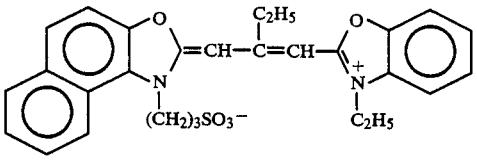

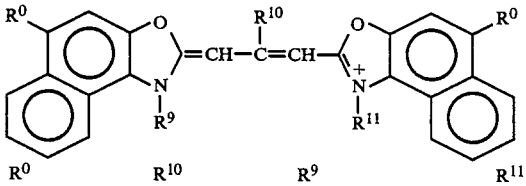

| | $R^0$ | $R^{10}$ | $R^9$ | $R^{11}$ |
|---|---|---|---|---|
| III-1 | H | $C_2H_5$ | $(CH_2)_3SO_3K$ | $(CH_2)_3SO_3^-$ |
| III-2 | H | $C_2H_5$ | $C_2H_5$ | $(CH_2)_3SO_3^-$ |
| III-3 | $OCH_3$ | H | $(CH_2)_3SO_3K$ | $(CH_2)_3SO_3^-$ |
| III-4 | H | $CH_3$ | $(CH_2)_3SO_3K$ | $(CH_2)_3SO_3^-$ |
| III-5 | H | H | $C_2H_5$ | $(CH_2)_3SO_3^-$ |
| III-6 | H | $CH_3$ | $C_2H_5$ | $(CH_2)_3SO_3^-$ |
| III-7 | H | H | $CH_3$ | $(CH_2)_3SO_3^-$ |
| III-8 | H | $CH_3$ | $CH_3$ | $(CH_2)_3SO_3^-$ |
| III-9 | H | $C_2H_5$ | $CH_3$ | $(CH_2)_3SO_3^-$ |

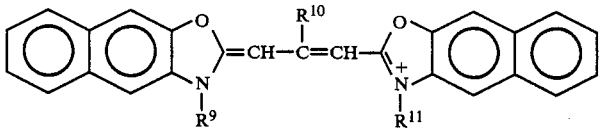

| | $R^{10}$ | $R^9$ | $R^{11}$ |
|---|---|---|---|
| III-10 | $C_2H_5$ | $(CH_2)_3SO_3K$ | $(CH_2)_3SO_3^-$ |
| III-11 | $C_2H_5$ | $(CH_2)_4SO_3K$ | $(CH_2)_4SO_3^-$ |
| III-12 | $CH_3$ | $(CH_2)_4SO_3K$ | $(CH_2)_4SO_3^-$ |
| III-13 | $CH_3$ | $(CH_2)_3SO_3K$ | $(CH_2)_3SO_3^-$ |
| III-14 | $C_2H_5$ | $(CH_2)_3SO_3^-$ | $C_2H_5$ |
| III-15 | $CH_3$ | $(CH_2)_3SO_3^-$ | $C_2H_5$ |

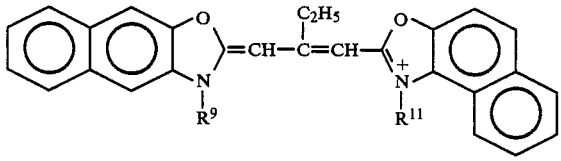

| | $R^9$ | $R^{11}$ |
|---|---|---|
| III-16 | $(CH_2)_3SO_3^-$ | $(CH_2)_3SO_3K$ |
| III-17 | $C_2H_5$ | $(CH_2)_3SO_3^-$ |
| III-18 | $(CH_2)_3SO_3K$ | $(CH_2)_3SO_3^-$ |
| III-19 | $(CH_2)_4SO_3^-$ | $C_2H_5$ |

Sensitizing dyes represented by the general formulae (I), (II) and (III) as used in the present invention, and the like can readily be synthesized according to methods disclosed in F. M. Hamer, "Heterocyclic Compounds - Cyanine dyes and related compounds -" chapters IV, V and VI, pages 86 to 199, John Wiley & Sons (New York, London) (1964); D. M. Sturmer, "Heterocyclic Compounds Special topics in heterocyclic chemistry -" chapter VIII, sec. IV, pages 482 to 515, John Wiley & Sons (New York, London) (1977); and the like.

A sensitizing dye used in the present invention can directly be dispersed in an emulsion. Alternatively, it can first be dissolved in a suitable solvent, for example methyl alcohol, ethyl alcohol, methyl cellosolve, acetone, water or pyridine or a mixed solvent thereof, and then added to an emulsion as a solution. Ultrasonic wave can be used to dissolve it. As a method for addition of this sensitizing dye, a method as disclosed in U.S. Pat. No. 3,469,987 or the like wherein a dye is dissolved in a volatile organic solvent, the solution is dispersed in a hydrophilic colloid, and the dispersion is added to an emulsion; a method as disclosed in J. P. KOKOKU No. 46-24185 or the like wherein a water insoluble dye is dispersed in a water soluble solvent without dissolving it, and this dispersion is added to an emulsion; a method as disclosed in U.S. Pat. No. 3,822,135 or the like wherein a dye is dissolved in a surfactant and the solution is added to an emulsion; a method as disclosed in J. P. KOKAI No. 51-74624 wherein a dye is dissolved using a compound capable of red shift, and the solution is added to an emulsion; a method as disclosed in J. P. KOKAI No. 50-80826 wherein a dye is dissolved an acid substantially free from water, and the solution is added to an emulsion; or the like may be used. Furthermore, a method for addition to an emulsion disclosed in U.S. Pat. Nos. 2,912,343, 3,342,605, 2,996,287 or 3,429,835, or the like may also be used further, the above sensitizing dye may uniformly be dispersed in a silver halide emulsion before it is applied on a suitable support, and may of course be dispersed in any step for preparation of a silver halide emulsion.

That is, the sensitizing dye may be added in any step of preparation of a photographic emulsion, or in any stage from after preparation of the emulsion to just before application thereof Examples of the former stage are a silver halide grain-forming step, a physical ripening step, a chemical ripening step and the like A sensitizing dye of the present invention may be used in an amount sufficient for effectively increasing sensitivity of an emulsion The total amount of the dyes represented by formulas (I), (II) and (III) may widely be changed according to the condition of an emulsion to be used, but may preferably be an amount of $1\times10^{-6}$ to $5\times10^{31\ 3}$ moles, preferably $3\times10^{-6}$ to $2.5\times10^{-3}$ moles per 1 mole of the silver halide. Preferably, a molar ratio of the dyes of formulas (I), (II) and (III) is $50\pm20:30\pm10:20\pm10$.

Any silver halide among silver bromide, silver bromoiodide, silver bromochloreiodide, silver bromochloride and silver chloride may be used in the photographic emulsion of the present invention.

Silver halide grains in the photographic emulsion may be so-called regular grains which have a regular crystal shape such as cubic, octahedron or tetradecahedron, grains having an irregular crystal shape such as sphere, or grains having crystal defect such as twinning plane, or grains having a composite shape thereof.

Grain size of the silver halide may be a fine size of 0.1 μm or less, or a large size up to 10 μm in diameter of projected area. Further, an emulsion containing such silver halide may be a monodispersed emulsion having a narrow distribution, or a multi-dispersed emulsion having a wide distribution.

A silver halide photographic emulsion of the present invention can be prepared according to a known method, for example a method disclosed in Research Disclosure, No. 17643 (December, 1978), pages 22 to 23 ("I. Emulsion preparation and types"), or ibid. No. 18716 (November, 1979), page 648.

A photographic emulsion cf the present invention can also be prepared using a method disclosed in P. Glafkides, Chimie et Physique Photographique, Paul Montel, 1967; G. F. Duffin, Photographic Emulsion Chemistry, Focal Press, 1966; V. L. Zelikman et al., Making and Coating Photographic Emulsion, Focal Press, 1964, or the like. That is, any of an acidic method, a neutral method, an ammonia method and the like may be utilized, and as for a method for reacting a soluble silver salt with a soluble halogen salt, any of a single-jet method, a simultaneous jet method and a combination thereof may be utilized. Further, a method wherein grains are formed using excess silver ions (a so-called reverse-jet method) can also be utilized. Further, a method wherein pAg in a liquid phase where a silver halide is formed is held constant, namely a socalled controlled double-jet method can also be used as a mode of a simultaneous-jet method. According to this method, a silver halide emulsion containing grains having a regular crystal shape and an almost uniform size may be obtained.

Further, it is also possible to mix 2 or more kinds of silver halide emulsions which were separately prepared.

A silver halide emulsion comprising the aforementioned regular grains may be obtained by controlling pAg and pH during formation of grains, as is detailedly described, for example in Photographic Science and Engineering, vol. 6, pages 159 to 165 (1962); Journal of Photographic Science, vol. 12, pages 242 to 251 (1964); U.S. Pat. No. 3,655,394 or U.K. Pat. No. 1,413,748.

Typical monodispersed emulsion is such an emulsion that contains silver halide grains which have an average grain size more than about 0.1 μm and at least 95 weight % of which have grain sizes which fall within ±40% of the average grain size. An emulsion which contain silver halide grains which have an average grain size of 0.25 to 2 μm, and at least 95 weight % or at least 95% in number of which have grain sizes which fall within ±20% of the average grain size can also be used in the present invention. Processes for preparation of such an emulsion are disclosed in U.S. Pat. Nos. 3,574,628 and 3,655,394 and U.K. Pat. No. 1,413,748. Monodispersed emulsions disclosed in J. P. KOKAI Nos. 48-8600, 51-39027, 51-83097, 53-137133, 54-48521, 54-99419, 58-37635, 58-49938 and the like can also preferably be used in the present invention.

Further, tabular grains having an aspect ratio of 5 or more can also be used in the present invention. Tabular grains can readily be prepared according to a method disclosed in U.S. Pat. Nos. 4,434,226, 4,414,310, 4,433,048 or 4,439,520, U.K. Pat. No. 2,112,157, or the like. When tabular grains are used, various advantages such as enhancement of spectral sensitization efficiency by a sensitizing dye, enhancement of graininess and increase of sharpness are brought about, which is detailedly described in U.S. Pat. No. 4,434,226 referred to above.

Crystals of silver halide may be composed of a uniform structure, a halogen composition heterogenous between inside and outside, or a layer structure. Such various emulsion grains are disclosed in U.K. Pat. No. 1,027,146, U.S. Pat. Nos. 3,505,068 and 4,444,877, J. P. KOKAI No. 60-143331, and the like.

As for halogen distribution in grains, halogen may be either uniformly distributed or distributed with a composition heterogenous between inside and outside, or layers each having a mutually heterogenous halogen composition are superposed. Particularly preferred grains are those having substantially two distinct layer structures (core/shell structure) composed of core part of a higher iodine content and shell part of a lower iodine content.

Further, silver halides mutually having different compositions may be conjugated by epitaxial conjunction, and a silver halide may be conjugated with a compound other than silver halide such as silver rhodanide or lead oxide by epitaxial conjuction. These emulsion grains are disclosed in U.S. Pat. Nos. 4,094,684, 4,142,900 and 4,459,353, U.K. Pat. No. 2,038,792, U.S. Pat. Nos. 4,349,622, 4,395,478, 4,433,501, 4,463,087, 3,656,962 and 3,852,067, J. P. KOKAI No. 59-162540, and the like.

Further, it is possible to use a mixture of grains of various crystal shapes.

Emulsions of the present invention are usually subjected to physical ripening and chemical ripening prior to use. Additives to be used in such steps are disclosed in Research Disclosure Nos. 17643 and 18716, and the relevant parts are summarized in the following table.

Known photographic additives usable in the present invention are also disclosed in the above two Research Disclosure Journals, and the relevant parts are summarized in the following table.

| Kind of additive | RD 17643 | RD 18716 |
|---|---|---|
| 1. Chemically sensitizing agent | page 23 | page 648, right column (r.c.) |
| 2. Sensitivity-enhancing agent | | page 648, right column (r.c.) |
| 3. Spectrally sensitizing agent | pages 23–24 | page 648 r.c. - page 649 r.c. |
| 4. Antifoggant and stabilizing agent | pages 24–25 | page 649 r.c. |
| 5. Light-absorbing agent, Filter dye and UV absorbent | pages 25–26 | page 649 r.c. - page 650 left column (l.c.) |
| 6. Stain inhibitor | page 25 r.c. | pages 650 |
| 7. Hardening agent | page 26 | page 651 l.c. |
| 8. Binder | page 26 | page 651 l.c. |
| 9. Plasticizer and lubricant | page 27 | page 650 r.c. |
| 10. Coating aid and surfactant | pages 26–27 | do. |
| 11. Static inhibitor | page 27 | do. |

Various color-forming couplers can be used in the present invention, and specific examples thereof are disclosed in patents listed in the above Research Disclosure (RD) No. 17643, VII-C - G. As dye-forming couplers, couplers which respectively give three primary colors (i.e., yellow, magenta and cyan) in substrative color process by color development are important. Examples of nondiffusible 4- or 2-equivalent couplers preferably used in the present invention include couplers disclosed in patents disclosed in the aforementioned RD No. 17643, VII-C and D items as well as couplers described below.

Typical yellow dye-forming couplers usable in the present invention include hydrophobic acylacetoamide type couplers having a ballast group. Specific examples thereof are disclosed in U.S. Pat. Nos. 2,407,210, 2,875,057 and 3,265,506, and the like. 2-Equivalent yellow dye-forming couplers are preferably used in the present invention, and typical examples thereof include oxygen atom-coupling off type yellow dye-forming couplers disclosed in U.S. Pat. Nos. 3,408,194, 3,447,928, 3,993,501 and 4,022,620, and the like, and nitrogen atom-coupling off type yellow dye-forming couplers disclosed in J. P. KOKOKU No. 58-10739, U.S. Pat. Nos. 4,401,752 and 4,326,024, RD No. 18053 (April, 1979), U.K. Pat. No. 1,425,020, German Patent Unexamined Published APPLICATION (OLS) Nos. 2,219,917, 2,261,361, 2,329,587 and 2,433,812, and the like. α-Pivaloylacetanilide type couplers are excellent in fastness, particularly light fastness of their colored dyes, and on the other hand α-benzoylacetanilide type couplers give high color densities.

Magenta dye-forming couplers usable in the present invention include indazolone type, cyanoacetyl type, 5-pyrazolone type and pyrazoloazole type couplers which each have a ballast group and are hydrophobic, and 5-pyrazolone type and pyrazoloazole type couplers are preferable. As 5-pyrazolone type couplers, those whose 3-positions are each substituted with an arylamino group or an acylamino group are preferable in view of the hue or color density of their colored dyes, and typical examples thereof are disclosed in U.S. Pat. Nos. 2,311,082, 2,343,703, 2,600,788, 2,908,573, 3,062,653, 3,152,896, and 3,936,015, and the like. As a coupling-off group of a 2-equivalent 5-pyrazolone type coupler, a nitrogen atom - coupling off group disclosed in U.S. Pat. No. 4,310,619, or an arylthio group disclosed in U.S. Pat. No. 4,351,897 is particularly preferred. A 5-pyrazolone type coupler having a ballast group as disclosed in European Pat. No. 73,636 gives a high color density. As pyrazoloazole type couplers, pyrazolobenzimidazoles disclosed in U.S. Pat. No. 3,369,879, pyrazolo(5,1-c)(1,2,4)triazoles disclosed in U.S. Pat. No. 3,725,067, pyrazolotetrazoles disclosed in Research Disclosure No. 24,220 (June, 1984) and J. P. KOKAI No. 60-33552, and pyrazolopyrazoles disclosed in Research Disclosure No. 24,230 (June, 1984) and J. P. KOKAI No. 60-43659 may preferably be used. In view of reduced yellow subabsorption of a colored dye and light fastness of the colored dye, imidazo(1,2-b)pyrazoles disclosed in U.S. Pat. No. 4,500,630 are preferable, and pyrazolo(1,5-b)(1,2,4)triazole disclosed in European Pat. No. 119,860A is particularly preferable.

Cyan dye-forming couplers usable in the present invention include naphthol type and phenol type couplers which are hydrophobic and nondiffusible. Typical naphthol type couplers include naphthol type couplers disclosed in U.S. Pat. No. 2,474,293, and preferably oxygen atom-coupling off type 2-equivalent naphthol type couplers disclosed in U.S. Pat. Nos. 4,052,212, 4,146,396, 4,228,233 and 4,296,200. Specific examples of phenol type couplers are disclosed in U.S. Pat. Nos. 2,369,929, 2,801,171, 2,772,162 and 2,895,826, and the like. Cyan dye-forming couplers fast against humidity and temperature are preferably used in the present invention, and typical examples thereof include phenol type cyan dye-forming couplers having an alkyl group of an ethyl group and up at the meta position of the phenol nucleus as disclosed in U.S. Pat. No. 3,772,002; 2,5-diacylaminosubstituted phenol type couplers disclosed in U.S. Pat. Nos. 2,772,162, 3,758,308, 4,126,396, 4,334,011 and 4,327,173, OLS No. 3,326,729, European Pat. No. 121,365, and the like; phenol type couplers having a phenylureido group at the 2-position and an acylamino group at the 5-position as disclosed in U.S. Pat. Nos. 3,446,622, 4,333,999, 4,451,559 and 4,427,767, and the like; and the like.

In order to correct unnecessary absorption of a colored dye, it is preferable in color light-sensitive materials that masking is carried out by using a colored coupler together. Typical examples of the colored couplers include yellow-colored magenta dye-forming couplers disclosed in U.S. Pat. No. 4,163,670, J. P. KOKOKU No. 57-39413 and the like; magenta-colored cyan dye-forming couplers disclosed in U.S. Pat. Nos. 4,004,929 and 4,138,253, U.K. Pat. No. 1,146,368, and the like; and the like. Other colored couplers are disclosed in the aforementioned RD No. 17643, Items VII - G.

It is possible to improve graininess by using such a coupler that a colored dye derived therefrom has a proper diffusibility.

As such couplers, specific examples of magenta dye-forming couplers are disclosed in U.S. Pat. No. 4,366,237 and U.K. Pat. No. 2,125,570, and specific examples of yellow, magenta or cyan dye-forming couplers are disclosed in European Pat. No. 96,570 and OLS No. 3,234,533.

Dye-forming couplers and the above special couplers may each form polymers of dimer or more. Typical examples of polymerized dye-forming couplers are disclosed in U.S. Pat. Nos. 3,451,820 and 4,080,211. Specific examples of polymerized magenta dye-forming couplers are disclosed in U.K. Pat. No. 2,102,173 and U.S. Pat. No. 4,367,282.

Couplers releasing a photographically useful residue together with coupling can also preferably be used in the present invention. As DIR couplers each releasing a development inhibitor, couplers disclosed in patents disclosed in the aforementioned RD No. 17643, item VII - F are useful.

Preferred DIR couplers to be used in combination with the present invention include developing solution-inactivating type DIR couplers typically disclosed in J. P. KOKAI No. 57-151944; timing type DIR couplers typically disclosed in U.S. Pat. No. 4,248,962 and J. P. KOKAI No. 57-154234; and reaction type DIR couplers typically disclosed in J. P. KOKAI No. 60-184248. Particularly preferred DIR couplers include developing solution-inactivating type DIR couplers disclosed in J. P. KOKAI Nos. 57-151944, 58-217932, 60-218644, 60-225156 and 60-233650, and the like, and reaction type DIR couplers disclosed in J. P. KOKAI No. 60-184248 and the like.

Examples of suitable supports usable for photographic light-sensitive materials having a photographic emulsion of the present invention include those disclosed, for example in the aforementioned RD No. 17643, page 28 and RD No. 18716, page 647 right column to page 648 left column.

Photographic light-sensitive materials to which a photographic emulsion of the present invention is applicable include various color and black-and-white light-sensitive materials. Examples of such light-sensitive materials include color negative films for photographing (for generic use, movie and the like), reversal color films (for slide, movie and the like; couplers are either included or not included), color photographic papers, color positive films (for movie and the like), reversal color photographic papers, color light-sensitive materials for heat development, color light-sensitive materials by use of a silver dye bleaching method, photographic light-sensitive materials for making printing plates (litho-film, scanner film and the like), X-ray photographic light-sensitive materials (for direct or indirect medical use, industrial use, and the like), black-and-white negative films for photographing, black-and-white photographic papers, light-sensitive materials for micro-use (for COM, microfilm and the like), color diffusion transfer light-sensitive materials (DTR), silver salt diffusion transfer light-sensitive materials, print-out light-sensitive materials, and the like.

Exposure to light for obtaining a photographic image by a photographic light-sensitive material using a photographic emulsion of the present invention may be carried out using an usual method. That is, any of various known light sources containing infrared light such as natural light (sunlight), a tungsten lamp, a fluorescent lamp, a mercury lamp, a xenon arc lamp, a carbon arc lamp, a xenon flash lamp, cathode ray tube flying spot, luminescent diode, laser light (e.g., gas laser, YAG laser, dye laser, semiconductor laser and the like), and the like. Exposure to light may also be carried out by light emitted from a fluorescent material excited with electron beams, X-rays, $\gamma$-rays, $\alpha$-rays or the like. Exposure time may first be 1/1000 to one second used in an ordinal camera, may also be a time shorter than 1/1000 second, for example $1/10^4$ to $1/10^6$ second in case of using a xenon flash lamp or a cathode ray tube, and may further be a time longer than one second. It is possible, according to necessity, to adjust spectral composition of light used in exposure using a color filter.

A photographic light-sensitive material to which a photographic emulsion of the present invention is applicable can be developed according to a usual method disclosed in the aforementioned RD No. 17643, pages 28 to 29, or RD No. 18716, page 651 left column to right column.

A color developing solution used for developing process of light-sensitive materials of the present invention is preferably an aqueous alkaline solution containing an aromatic primary amine type color developing agent as a main component. As color developing agents, p-phenylenediamine type compounds are preferably used, though aminophenol type compounds are also useful. Representative examples of p-phenylenediamine type compounds include 3-methyl-4-amino-N,N-diethylaniline, 3-methyl-4-amino-N-ethyl-N-$\beta$-hydroxyethylaniline, 3-methyl-4-amino-N-ethyl-N-$\beta$-methanesulfonamidoethylaniline and 3-methyl-4-amino-N-ethyl-N-$\beta$-methoxyethylaniline, and sulfate, hydrochloride, p-toluenesulfonate and the like thereof. These diamines in salt state are generally stabler than in free state, and preferably used.

A color developing solution generally contains a pH buffer such as carbonate, borate, phosphate or the like of an alkali metal; a development inhibitor or antifoggant such as a bromide, an iodide, benzimidazole, benzothiazole or a mercapto compound. Further, according to necessity, a preservative such as hydroxylamine or a sulfite; an organic solvent such as triethanolamine or diethylene glycol; a development accelerator such as benzyl alcohol, polyethylene glycol, a quaternary ammonium salt or an amine; a dye forming coupler; a competing coupler; a nucleating agent such as sodium borohydride; an auxiliary developing agent such as 1-phenyl-3-pyrazolidone; a thickner; a chelating agent represented by an aminopolycarboxylic acid, an aminopolyphosphonic acid, an alkylphosphonic acid or a phosphonocarboxylic acid; an antioxidant such as one disclosed in OLS No. 2,622,950; or the like may be added to the color developing solution.

In developing process of a reversal color light-sensitive material, color development is generally carried out after black-and white development For preparation of a black-and-white developing solution, known black-and-white developing agents, for example dihydroxybenzenes such as hydroquinone; 3-pyrazolidones such as 1-phenyl-3-pyrazolidone; aminophenols such as N-methyl-p-aminophenol; or the like may be used alone or in combination.

Photographic emulsion layers after color development are usually subjected to bleaching process. Bleaching process may simultaneously be carried out with fixing process, or they may separately be carried out. Further, a process method where bleach-fixing process is carried out after bleaching process may also be adopted for rapid processing. As a bleaching agent, a compound of a polyvalent metal such as iron (III), cobalt (III), chromium (VI) or copper (II); a peracid; a quinone; a nitroso compound; or the like may be used. Representative examples of a bleaching agent which may be used include a ferricyanide; a bichromate; an organic complex salt of iron (III) or cobalt (III), for example a complex salt of an aminopolycarboxylic acid such as ethylenediaminetetraacetic acid, diethylenetriaminepentaacetic acid, nitrilotriacetic acid or 1,3-diamino-2-propanoltetraacetic acid, or a organic acid such as citric acid, tartaric acid or malic acid with iron (III) or cobalt (III); a persulfate; a manganate; nitrosophenol; or the like. Among them, an (ethylenediaminetetraacetato)iron (III), a (diethylenetriaminepentaacetato)iron (III) and a persulfate are preferable in view of rapid processing and prevention of environmental pollution. Further, an (ethylenediaminetetraacetato)iron (III) complex salt is particularly useful for a single bleaching solution as well as a single bath bleach-fixing solution.

A bleach accelerator may be used according to necessity for a bleaching solution, a bleach-fixing solution or a pre-bath thereof. Specific examples of useful bleach accelerators include compounds each having a mercapto group or a disulfido group as disclosed in U.S. Pat. No. 3,893,858, West Germany Pat. No. 1,290,812 or 2,059,988, J. P. KOKAI No. 53-32736, 53-57831, 53-37418, 53-65732, 53-72623, 53-95630, 53-95631, 53-104232, 53-124424, 53-141623 or 53-28426, or Research Disclosure No. 17129 (July, 1978) or the like; thiazoline derivatives disclosed in J. P. KOKAI No. 50-140129 or the like; thiourea derivatives disclosed in J. P. KOKOKU No. 45-8506, J. P. KOKAI No. 52-20832 or 53-32735, or U.S. Pat. No. 3,706,561; iodides disclosed in West Germany Pat. No. 1,127,715 or J. P. KOKAI No. 58-16235; polyethylene oxides disclosed in West Germany Pat. No. 966,410 or 2,748,430; polyamine compounds disclosed in J. P. KOKOKU No. 45-8836; and further compounds disclosed in J. P. KOKAI No. 49-42434, 49-59644, 53-94927, 54-35727, 55-26506 or 58-163940, iodine ions and bromine ions. Among them, compounds each having a mercapto group or a disulfido group are preferable in view of large accelerating effects, compounds disclosed in U.S. Pat. No. 3,893,858, West Germany Pat. No. 1,290,812 or J. P. KOKAI No. 53-95630 are particularly preferred. Further, compounds disclosed in U.S. Pat. No. 4,552,834 are also preferred. Such a bleach accelerator may also be added in a light-sensitive material. These bleach accelerators are particularly effective when color light-sensitive materials for photographing are bleached and fixed.

Color photographic light-sensitive materials of the present invention can also be subjected to bleach-fixing process according to a method disclosed in Japanese patent application No. 60-172968.

As a fixing agent, a thiosulfate, a thiocyanate, a thioether type compound, a thiourea, a large amount of an iodide, or the like may be used, but use of a thiosulfate is general. As a preservative for a bleach-fixing solution or a fixing solution, a sulfite, a bisulfite or a carbonylbisulfite adduct may preferably be used.

It is in general that process steps such as water washing and stabilization are carried out after a fixing step or a bleach-fixing step, but it is also possible to use a simple process method such as a method where only water washing is carried out or a method where only stabilizing process is carried out without a substantial water washing step.

In this connection, water washing step is a step for removing processing solution components adhered on or occluded in a color light-sensitive material, or components in a color light-sensitive material which turned to be unnecessary to maintain preservability of the image and physical properties of the film after processing good. On the other hand, stabilizing step is a step for enhancing preservability of the image to a level which can not be attained by water washing.

Water washing step is usually carried out by a multistep counterflow water washing method using 2 or more baths, though the step may also be carried out using a single bath. Water amount to be used in a water washing step can freely be determined according to kind of the color light-sensitive material and object, but can also be calculated out according to a method disclosed in Journal of Motion Picture and Television Engineering, 64, 248–253 (May, 1955) (S. R. Goldwasser, "Water Flow Rates in Immersion-Washing of Motion Picture Film").

Though generation of bacteria or fungi become a problem when water amount for washing is reduced for economy, it is preferable as a countermeasure therefor to use washing water whose calcium and magnesium contents are reduced as disclosed in Japanese patent application No. 61-131632. Further, it is also possible to add a disinfectant or an antifungal agent, for example a compound disclosed in J. Antibact. Antifug. Agents, vol. 11 (No. 5), p 207–223 (1983) or a compound disclosed in Hiroshi Horiguchi, "Bokin Bobai no Kagaku" (Chemistry for antibacterial or antifungal purpose). Further, it is also possible to add a chelating agent such as ethylenediaminetetraacetic acid or diethylenetriaminepentaacetic acid as a water softener.

Water amount to be used as a result of reduction usually ranges from 100 to 2000 ml per 1 $m^2$ of a color light-sensitive material, and range from 200 to 1000 ml is preferably used for attaining both image stability and water saving effect.

pH in the water washing step is usually 5 to 9. Other various compounds are added to a stabilizing bath for stabilizing the image. For example, various buffers for adjusting pH of the film after processing such as borates, methaborates, borax, phosphates, carbonates, potassium hydroxide, sodium hydroxide, ammonia water, monocarboxylic acids, dicarboxylic acids, polycarboxylic acids or the like in combination; a chelating agent similar to one which may be added to washing water; a disinfectant; and further a fluorescent whitener according to uses can be added to a stabilizing bath, or further various ammonium salts such as ammonium chloride, ammonium sulfite, ammonium sulfate, ammonium thiosulfate and the like may be added.

pH of the stabilizing bath is usually 3 to 8, and in some occasions low pH region of 3 to 5 is preferably used because of difference of light-sensitive material species or use purpose.

The present invention can be applied to various color light-sensitive materials. Representative examples thereof include color light-sensitive materials for photographing such as color negative films for generic use or for movie and color reversal films for slide, movie or television; color internegative films for movie or generic use as used for reproduction of an original image; and the like.

A silver halide color light-sensitive material of the present invention may contain a color developing agent for the purpose of making processing simple and rapid. As color developing agents for such purpose, various precursors of a color developing agent may preferably be used. Examples of such precursors include, for example, indoaniline type compounds disclosed in U.S. Pat. No. 3,342,597; Schiff base type compounds disclosed in U.S. Pat. No. 3,342,599, or Research Disclosure No. 14850 or 15159; aldol compounds disclosed in Research Disclosure No. 13924; metal salt complexes disclosed in U.S. Pat. No. 3,719,492; and urethane type compounds disclosed in J. P. KOKAI No. 53-135628; and further various salt type precursors disclosed in J. P. KOKAI No. 56-6235, 56-16133, 56-59232, 56-67842, 56-83734, 56-83735, 56-83736, 56-89735, 56-81837, 56-54430, 56-106241, 56-107236, 57-97531 or 57 83565 or the like.

Silver halide color light-sensitive materials of the present invention may contain various 1-phenyl-3-pyrazolidones according to necessity for the purpose of promoting color development. Typical examples of such compounds and disclosed in J. P. KOKAI Nos. 56-64339, 57-144547, 57-211147, 58-50532, 58-50536, 58-50533, 58-50534, 58-50535 and 58-115438 and the like.

Various processing solutions in the present invention are used at 10° to 50° C. Though a temperature of 33° to 38° C. is standard, it is possible to promote processing and shorten processing time by selecting a higher temperature, or to enhance image quality or improve stability of the processing solution by selecting a lower temperature. Further for economy of silver in light-sensitive materials, it is possible to carry out process using cobalt intensifier or hydrogen peroxide intensifier disclosed in West Germany Pat. No. 2,226,770 or U.S. Pat. No. 3,674,499.

Heaters, temperature sensors, liquid level sensors, circulating pumps, filters, floating covers, squeezes or the like may be provided in various processing baths according to necessity.

Further, in continuous process, constant finishing may be obtained by preventing change of solution composition using a replenisher for the processing solution. Amount of a replenisher may be lowered to half or less of standard replenisher amount for cost reduction or the like.

Examples of the present invention are demonstrated below, but the present invention should not be interpreted as limited only to these examples.

EXAMPLE 1

Silver halide grains are formed by a double-jet method, successively followed by physical ripening process, desalting process and chemical ripening process to obtain a silver iodobromide (containing 7.5 mole % iodine) emulsion. The average size of silver halide grains contained in this emulsion was 0.8 μm. Further, 0.55 mol of silver halide was contained in 1 kg of this emulsion.

One kilogram of the emulsion was placed in a pot and dissolved with heating to 40° C. One of methanol solutions of sensitizing dyes listed in Table 1 was added thereto, and the mixture was stirred. Then 10 ml of an aqueous 1.0 weight % 4-hydroxy-6-methyl-1,3,3a,7-tetrazaindene solution, 10 ml of an aqueous 1.0 weight % 1-hydroxy-3,5-dichlorotriazine sodium salt solution, and 10 ml of an aqueous 1.0 weight % sodium dodecylbenzenesulfonate solution were successively added thereto, followed by stirring. This complete emulsion was applied onto a cellulose triacetate film base to a dried film thickness of 5 μm, and dried to obtain samples 101 to 123.

Each of these film samples was subjected to wedge exposure using a sensitometer having a light source of color temperature of 4800° K., which was accompanied with a yellow filter (SC-50 manufactured by FUJI PHOTO FILM CO., LTD.).

After exposure to light, each of the film samples was developed at 20° C. for 7 minutes using a developing solution having the following composition, subjected successively to stop and fixing processes, and then washed with water to obtain a strip having a black-and-white image. This strip was subjected to density measurement using a P type densitometer manufactured by FUJI PHOTO FILM CO., LTD. to obtain sensitivity and fog. Reference point of optical density for determination of sensitivity was point of (fog+0.20).

| Composition of the developing solution | |
|---|---|
| Water | 700 ml |
| Metol | 2.0 g |
| Anhydrous sodium sulfite | 100.0 g |
| Hydroquinone | 5.0 g |
| Borax pentahydrate | 1.5 g |
| Water to | 1 l |

Results are shown in Table 1 using the fogging value and sensitivity value of sample 101 of fresh performance (i.e., immediately after preparation of the sample), respectively as a standard. Further, samples 101 to 123 were, after preservation for 3 days at 50° C. with 80% RH, similarly exposed to light and developed, and fog and sensitivity were determined. The results are shown in Table 1.

Sensitizing dyes used in comparative examples are as follows.

SD-1

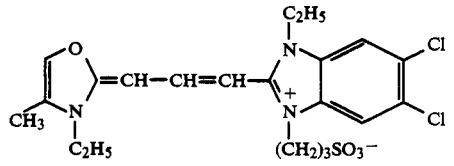

SD-2

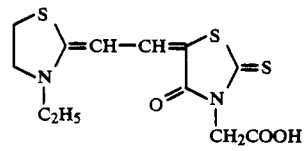

SD-3

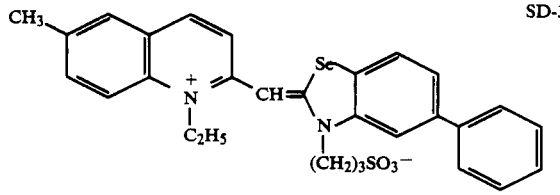

TABLE 1-1

| Sample No. | | Sensitizing dye A | | Sensitizing dye B | Sensitizing dye C | Fresh performance Fog | Fresh performance Relative sensitivity | After preservation for 3 days (50° C., 80% RH) Fog | After preservation for 3 days (50° C., 80% RH) Relative sensitivity |
|---|---|---|---|---|---|---|---|---|---|
| 101 | I-2 | $3.2 \times 10^{-4}$ | III-10 | $1.6 \times 10^{-4}$ | — | ±0 | 100 | +0.01 | 96 |

TABLE 1-1-continued

| Sample No. | Sensitizing dye A | | Sensitizing dye B | | Sensitizing dye C | Fresh performance Fog | Fresh performance Relative sensitivity | After preservation for 3 days (50° C., 80% RH) Fog | After preservation for 3 days (50° C., 80% RH) Relative sensitivity |
|---|---|---|---|---|---|---|---|---|---|
| (p.i.) | | mol/mol Ag | | mol/mol Ag | | (standard) of fog) | (standard of sensitivity) | | |
| 102 (p.i.) | I-7 | $3.2 \times 10^{-4}$ mol/mol Ag | III-10 | $1.6 \times 10^{-4}$ mol/mol Ag | — | −0.01 | 102 | +0.01 | 98 |
| 103 (p.i.) | I-2 | $3.2 \times 10^{-4}$ mol/mol Ag | III-17 | $1.6 \times 10^{-4}$ mol/mol Ag | — | +0.01 | 100 | +0.03 | 96 |
| 104 (p.i.) | I-7 | $3.2 \times 10^{-4}$ mol/mol Ag | III-17 | $1.6 \times 10^{-4}$ mol/mol Ag | — | +0.02 | 103 | +0.02 | 98 |
| 105 (c.e.) | SD-1 | $3.2 \times 10^{-4}$ mol/mol Ag | III-10 | $1.6 \times 10^{-4}$ mol/mol Ag | — | +0.09 | 104 | +0.18 | 87 |
| 106 (c.e.) | SD-2 | $3.2 \times 10^{-4}$ mol/mol Ag | III-10 | $1.6 \times 10^{-4}$ mol/mol Ag | — | +0.15 | 96 | +0.29 | 62 |
| 107 (c.e.) | SD-3 | $3.2 \times 10^{-4}$ mol/mol Ag | III-10 | $1.6 \times 10^{-4}$ mol/mol Ag | — | +0.06 | 90 | +0.13 | 66 |
| 108 (c.e.) | SD-1 | $3.2 \times 10^{-4}$ mol/mol Ag | III-17 | $1.6 \times 10^{-4}$ mol/mol Ag | — | +0.11 | 104 | +0.19 | 89 |
| 109 (c.e.) | SD-2 | $3.2 \times 10^{-4}$ mol/mol Ag | III-17 | $1.6 \times 10^{-4}$ mol/mol Ag | — | +0.21 | 93 | +0.32 | 60 |
| 110 (c.e.) | SD-3 | $3.2 \times 10^{-4}$ mol/mol Ag | III-17 | $1.6 \times 10^{-4}$ mol/mol Ag | — | +0.08 | 90 | +0.14 | 64 |
| 201 (p.i.) | I-2 | $2.0 \times 10^{-4}$ mol/mol Ag | III-10 | $1.6 \times 10^{-4}$ mol/mol Ag | II-1 | $1.2 \times 10^{-4}$ mol/mol Ag | ±0 (standard of fog | 100 (standard of sensitivity) | +0.02 |
| 202 (p.i.) | I-7 mol-/mol Ag | $2.0 \times 10^{-4}$ | III-10 mol/-mol Ag | $1.6 \times 10^{-4}$ | II-1 mol/mol Ag | $1.2 \times 10^{-4}$ | −0.01 | 99 | 0.00 |
| 203 (p.i.) | I-2 mol-/mol Ag | $2.0 \times 10^{-4}$ | III-17 mol/-mol Ag | $1.6 \times 10^{-4}$ | II-1 mol/mol Ag | $1.2 \times 10^{-4}$ | +0.03 | 102 | +0.04 |
| 204 (p.i.) | I-7 mol-/mol Ag | $2.0 \times 10^{-4}$ | III-17 mol/-mol Ag | $1.6 \times 10^{-4}$ | II-1 mol/mol Ag | $1.2 \times 10^{-4}$ | +0.01 | 102 | +0.02 |
| 205 (p.i.) | I-7 mol-/mol Ag | $2.0 \times 10^{-4}$ | III-17 mol/-mol Ag | $1.6 \times 10^{-4}$ | II-1 mol/mol Ag | $2.8 \times 10^{-4}$ | +0.01 | 97 | +0.03 |
| 206 (c.e.) | SD-1 | $2.0 \times 10^{-4}$ | III-10 | $1.6 \times 10^{-4}$ mol/mol Ag | II-1 | $1.2 \times 10^{-4}$ mol/mol Ag | +0.10 | 106 | +0.19 |
| 207 (c.e.) | SD-2 | $2.0 \times 10^{-4}$ | III-10 | $1.6 \times 10^{-4}$ mol/mol Ag | II-1 | $1.2 \times 10^{-4}$ mol/mol Ag | +0.17 | 98 | +0.31 |
| 208 (c.e.) | SD-3 | $2.0 \times 10^{-4}$ | III-10 | $1.6 \times 10^{-4}$ mol/mol Ag | II-1 | $1.2 \times 10^{-4}$ mol/mol Ag | +0.08 | 92 | +0.15 |
| 209 (c.e.) | SD-1 | $2.0 \times 10^{-4}$ | III-17 | $1.6 \times 10^{-4}$ mol/mol Ag | II-1 | $1.2 \times 10^{-4}$ mol/mol Ag | +0.14 | 105 | +0.21 |
| 210 (c.e.) | SD-2 | $2.0 \times 10^{-4}$ | III-10 | $1.6 \times 10^{-4}$ mol/mol Ag | II-1 | $1.2 \times 10^{-4}$ mol/mol Ag | +0.26 | 93 | +0.35 |
| 211 (c.e.) | SD-3 | $2.0 \times 10^{-4}$ | III-10 | $1.6 \times 10^{-4}$ mol/mol Ag | II-1 | $1.2 \times 10^{-4}$ mol/mol Ag | +0.11 | 90 | +0.17 |

p.i. Present invention
c.e. Comparative example

EXAMPLE 2

A silver halide emulsion layer and a gelatin protective layer having the following compositions respectively were applied on a cellulose triacetate film support which had been provided with an undercoat to prepare samples 201 to 221.

(Light-sensitive layer composition)

Figure corresponding to each component means a coated amount represented by a unit of g/m$^2$, and means a coated amount in term of silver amount for silver halide. However, as for each of the sensitizing dyes, figure corresponding thereto means a coated amount represented by moles per 1 mole of the silver halide in the same layer.

| | |
|---|---|
| Emulsion layer | |
| Silver iodobromide emulsion silver iodide 6 mole %, variation coefficient (S/F) of grain size = | 2.0 |

-continued
| | |
|---|---|
| 0.18, aspect ratio 6.0, average grain size (F) = 0.8 μm | |
| Gelatin | 1.0 |
| Sensitizing dyes (described in Table 2) | |
| Cpd-5 | 0.25 |
| Cpd-15 | 0.25 |
| Cpd-8 | 0.03 |
| Cpd-7 | 0.05 |
| Oil-1 | 0.50 |
| Oil-4 | 0.13 |
| Protective layer | |
| Gelatin | 0.50 |
| Hardening agent H-1 | 0.40 |
Cpd-5
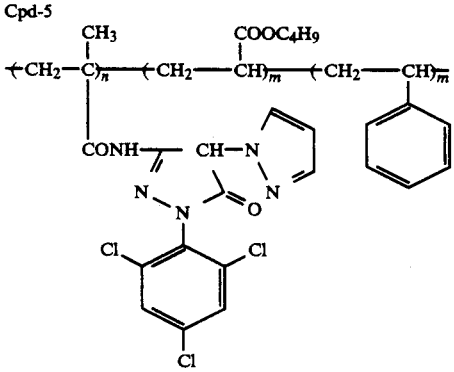
n = 50
m = 25
m' = 25
mol. wt. about 20,000
Cpd-7
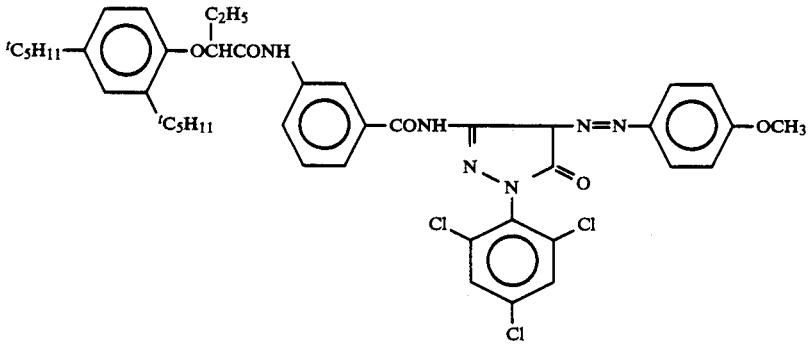
Cpd-8
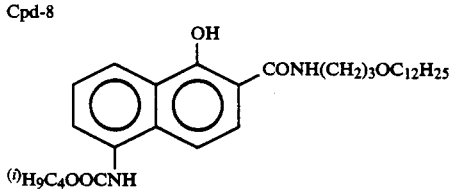
Cpd-15
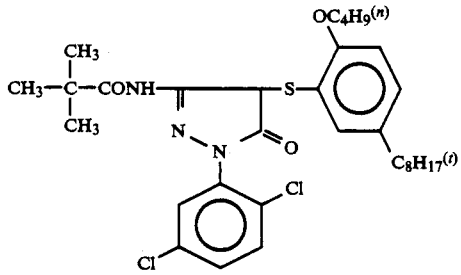
Oil-1
Tricresyl phosphate -continued
Oil-4
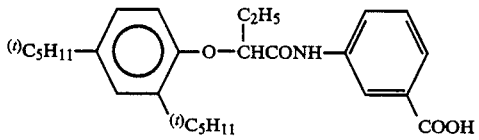
Hardening agent H-1
$CH_2{=}CHSO_2CH_2CONHCH_2$
$\quad\quad\quad TABLE 2-1-continued

| Sample No. | Sensitizing dye A | Sensitizing dye B | Sensitizing dye C | Fresh performance Fog | Fresh performance Relative sensitivity | After preservation for 3 days (50° C., 80% RH) Fog | After preservation for 3 days (50° C., 80% RH) Relative sensitivity |
|---|---|---|---|---|---|---|---|
| | | | | | | tivity) | |
| 202 (p.i.) | I-7 $2.5 \times 10^{-4}$ mol/mol Ag | III-10 $1.5 \times 10^{-4}$ mol/mol Ag | II-1 | $1.0 \times 10^{-4}$ mol/mol Ag | −0.02 | 101 | +0.01 |
| 203 (p.i.) | I-2 $2.5 \times 10^{-4}$ mol/mol Ag | III-19 $1.5 \times 10^{-4}$ mol/mol Ag | II-1 | $1.0 \times 10^{-4}$ mol/mol Ag | +0.03 | 103 | +0.06 |
| 204 (p.i.) | I-7 $2.5 \times 10^{-4}$ mol/mol Ag | III-19 $1.5 \times 10^{-4}$ mol/mol Ag | II-1 | $1.0 \times 10^{-4}$ mol/mol Ag | +0.03 | 102 | +0.04 |
| 205 (p.i.) | I-7 $2.5 \times 10^{-4}$ mol/mol Ag | — — mol/mol Ag | II-1 | $2.5 \times 10^{-4}$ mol/mol Ag | +0.02 | 96 | +0.04 |
| 206 (c.e.) | SD-1 $2.5 \times 10^{-4}$ mol/mol Ag | III-10 $1.5 \times 10^{-4}$ mol/mol Ag | II-1 | $1.0 \times 10^{-4}$ mol/mol Ag | +0.15 | 108 | +0.23 |
| 207 (c.e.) | SD-2 $2.5 \times 10^{-4}$ mol/mol Ag | III-10 $1.5 \times 10^{-4}$ mol/mol Ag | II-1 | $1.0 \times 10^{-4}$ mol/mol Ag | +0.22 | 99 | +0.37 |
| 208 (c.e.) | SD-3 $2.5 \times 10^{-4}$ mol/mol Ag | III-10 $1.5 \times 10^{-4}$ mol/mol Ag | II-1 | $1.0 \times 10^{-4}$ mol/mol Ag | +0.12 | 93 | +0.18 |
| 209 (c.e.) | SD-1 $2.5 \times 10^{-4}$ mol/mol Ag | III-19 $1.5 \times 10^{-4}$ mol/mol Ag | II-1 | $1.0 \times 10^{-4}$ mol/mol Ag | +0.19 | 106 | +0.27 |
| 220 (c.e.) | SD-2 $2.5 \times 10^{-4}$ mol/mol Ag | III-10 $1.5 \times 10^{-4}$ mol/mol Ag | II-1 | $1.0 \times 10^{-4}$ mol/mol Ag | +0.31 | 94 | +0.43 |
| 221 (c.e.) | SD-3 $2.5 \times 10^{-4}$ mol/mol Ag | III-10 $1.5 \times 10^{-4}$ mol/mol Ag | II-1 | $1.0 \times 10^{-4}$ mol/mol Ag | +0.17 | 92 | +0.23 |

p.i. Present invention
c.e. Comparative example

EXAMPLE 3

Preparation of sample 301

Multi-layered color light-sensitive material, which is herein referred to as sample 301, was prepared by providing each of the layers having the following compositions on a cellulose triacetate film support which had been undercoated.

(Composition of light-sensitive layer)

Coated amounts mean an amount represented by a unit of g/m$^2$ in terms of silver for silver halide and colloidal silver, an amount represented by a unit of g/m$^2$ for couplers, additives and gelatin, and moles per 1 mole of the silver halide in the same layer for each of the sensitizing dyes.

| | |
|---|---|
| The 1st layer (Antihalation layer) | |
| Black colloidal silver | 0.2 |
| Gelatin | 1.3 |
| Colored coupler Cpd-7 | 0.06 |
| Ultraviolet absorber UV-1 | 0.1 |
| Ultraviolet absorber UV-2 | 0.2 |
| Dispersion oil Oil-1 | 0.01 |
| Dispersion oil Oil-2 | 0.01 |
| The 2nd layer (Intermediate layer) | |
| Fine grain silver bromide (Average grain size 0.07 μm) | 0.15 |
| Gelatin | 1.0 |
| Colored coupler Cpd-27 | 0.02 |
| Dispersion oil Oil-1 | 0.1 |
| The 3rd layer (The 1st red-sensitive emulsion layer) | |
| Silver iodobromide emulsion Silver iodide 4 mole %, Variation coefficient of grain size (S/γ) = 0.12, Average grain size (γ) = 0.7 μm, which is hereinafter abridged as I⁻ 4 mole, S/γ = 0.12, 0.7 μm . . . 0.6 | 0.6(g/m$^2$) |
| Silver iodobromide emulsion I⁻ 3 mole, S/γ = 0.11, 0.3 μm | 0.3 |
| Gelatin | 0.6 |
| SD-4 | $4 \times 10^{-4}$ |
| SD-5 | $4 \times 10^{-5}$ |

-continued

| | |
|---|---|
| Cpd-9 | 0.010 |
| Cpd-10 | 0.010 |
| Cpd-21 | 0.50 |
| Cpd-27 | 0.04 |
| Oil-1 | 0.15 |
| Oil-3 | 0.02 |
| The 4th layer (The 2nd red-sensitive layer) | |
| Silver iodobromide emulsion I⁻ 6 mole, S/γ = 0.15, 1.0 μm | 0.7 |
| Gelatin | 1.0 |
| SD-4 | $4 \times 10^{-4}$ |
| SD-5 | $5 \times 10^{-5}$ |
| Cpd-24 | 0.1 |
| Cpd-28 | 0.1 |
| Oil-1 | 0.01 |
| Oil-3 | 0.05 |
| The 5th layer (Intermediate layer) | |
| Gelatin | 0.5 |
| Cpd-6 | 0.10 |
| Oil-1 | 0.05 |
| The 6th layer (The 1st green-sensitive emulsion layer) | |
| Silver iodobromide emulsion I⁻ 4 mole, S/γ = 0.11, 0.6 μm | 0.35 |
| Silver iodobromide emulsion I⁻ 3 mole, S/γ = 0.15, 0.3 μm | 0.20 |
| Gelatin | 1.0 |
| I-7 | $3.5 \times 10^{-4}$ |
| III-10 | $2.5 \times 10^{-4}$ |
| Cpd-5 | 0.3 |
| Cpd-7 | 0.07 |
| Cpd-13 | 0.03 |
| Oil-1 | 0.3 |
| Oil-4 | 0.1 |
| The 7th layer (The 2nd green-sensitive emulsion layer) | |
| Silver iodobromide emulsion I⁻ 6 mole, S/γ = 0.18, 0.8 μm | 0.8 |
| Gelatin | 0.5 |
| I-7 | $3.5 \times 10^{-4}$ |
| III-10 | $2.5 \times 10^{-4}$ |
| Cpd-5 | 0.1 |
| Cpd-15 | 0.1 |
| CPd-8 | 0.01 |
| CPd-7 | 0.02 |
| Oil-1 | 0.2 |

-continued

| | |
|---|---|
| The 8th layer (Intermediate layer) | |
| Gelatin | 0.5 |
| Cpd-6 | 0.05 |
| Oil-1 | 0.03 |
| The 9th layer (Donor layer of interlayer effect) | |
| Silver iodobromide emulsion Silver iodide 2 mole %, Aspect ratio 6.0, Average grain size, tabular grains of average grain size of 1.0 μm, which is hereinafter abridged as $I^-$ 2 mole, A/R = 6.0, 1.0 μm . . . 0.35 | 0.35(g/m²) |
| Silver iodobromide emulsion $I^-$ 2 mole, A/R = 6.5, 0.5 μm | 0.20 |
| Gelatin | 0.7 |
| I-7 | $8 \times 10^{-4}$ |
| Cpd-3 | 0.18 |
| Cpd-4 | 0.05 |
| Cpd-5 | 0.13 |
| Oil-1 | 0.20 |
| The 10th layer (Yellow filter layer) | |
| Gelatin | 0.5 |
| Cpd-2 | 0.25 |
| Cpd-6 | 0.10 |
| The 11th layer (The 1st blue-sensitive emulsion layer) | |
| Silver iodobromide emulsion $I^-$ 3 mole, A/R = 7.5, 1.0 μm | 0.3 |
| Silver iodobromide emulsion $I^-$ 3 mole, A/R = 7.5, 0.5 μm | 0.15 |
| Gelatin | 1.0 |
| SD-6 | $2 \times 10^{-4}$ |
| Cpd-1 | 0.05 |

-continued

| | |
|---|---|
| Cpd-8 | 0.10 |
| Cpd-29 | 0.80 |
| Oil-1 | 0.20 |
| The 12th layer (The 2nd blue-sensitive emulsion layer) | |
| Silver iodobromide emulsion $I^-$ 10 mole, S/γ = 0.11, 1.2 μm | 0.5 |
| Gelatin | 0.5 |
| SD-6 | $1 \times 10^{-4}$ |
| Cpd-29 | 0.20 |
| Cpd-3 | 0.02 |
| Oil-1 | 0.10 |
| The 13th layer (The 1st protective layer) | |
| Gelatin | 0.8 |
| UV-1 | 0.1 |
| UV-2 | 0.2 |
| Oil-1 | 0.01 |
| Oil-2 | 0.01 |
| The 14th layer (The 2nd protective layer) | |
| Fine grain silver bromide emulsion $I^-$ 2 mole, S/γ = 0.2, 0.07 μm | 0.5 |
| Gelatin | 0.45 |
| Polymethyl methacrylate grain size 1.5 μm | 0.2 |
| Hardening agent H-1 | 0.4 |
| Formaldehyde scavenger S-1 | 0.5 |
| Formaldehyde scavenger S-2 | 0.5 |

Besides the above components, a stabilizing agent of emulsion Cpd-26 and a surfactant were added to each layer as coating aids.

Cpd-1

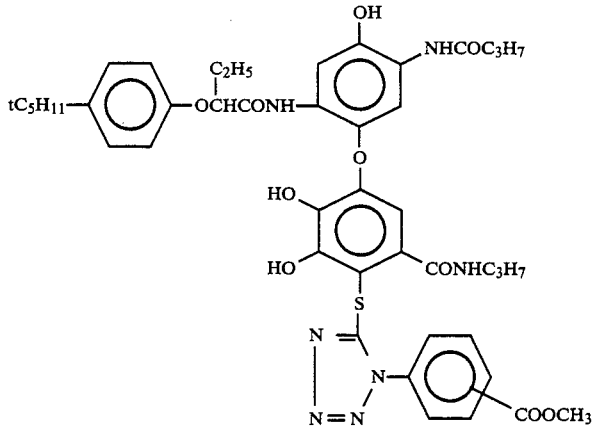

Cpd-2

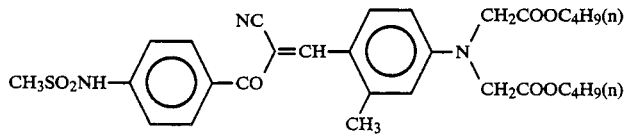

Cpd-3

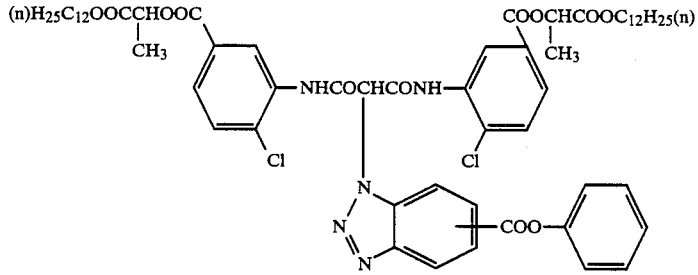

-continued
Cpd-4
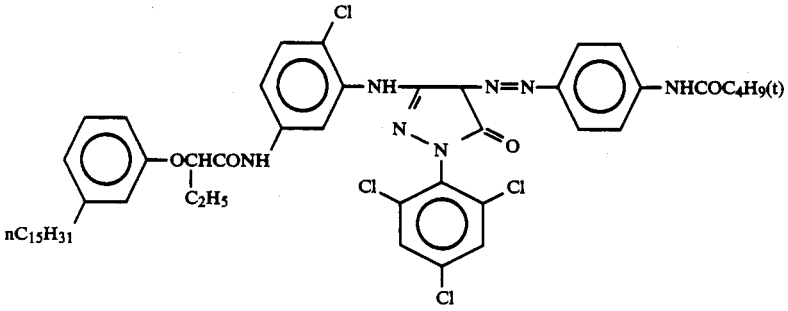
Cpd-6
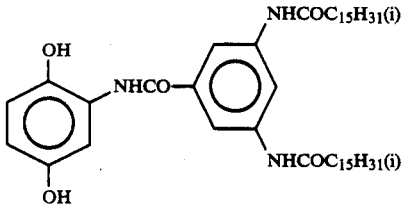
Cpd-9
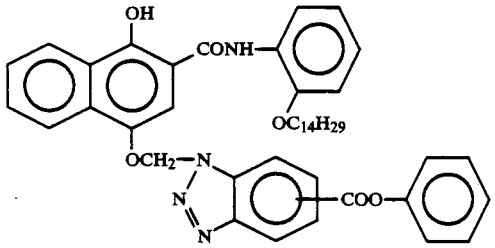
Cpd-12
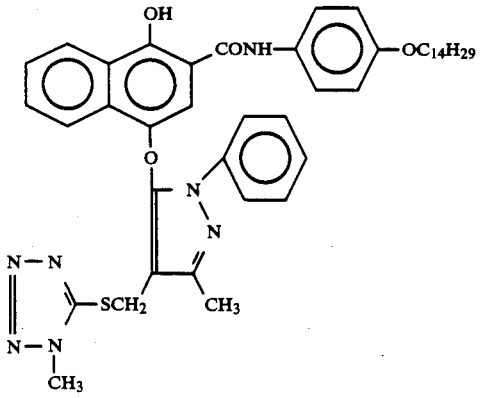
Cpd-13
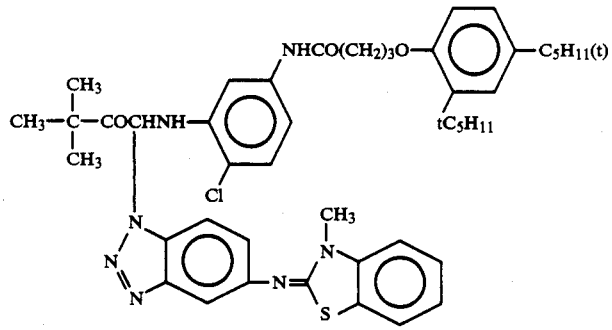

-continued
Cpd-14
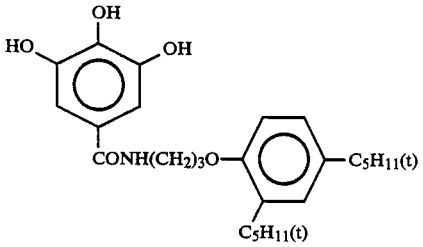
Cpd-16
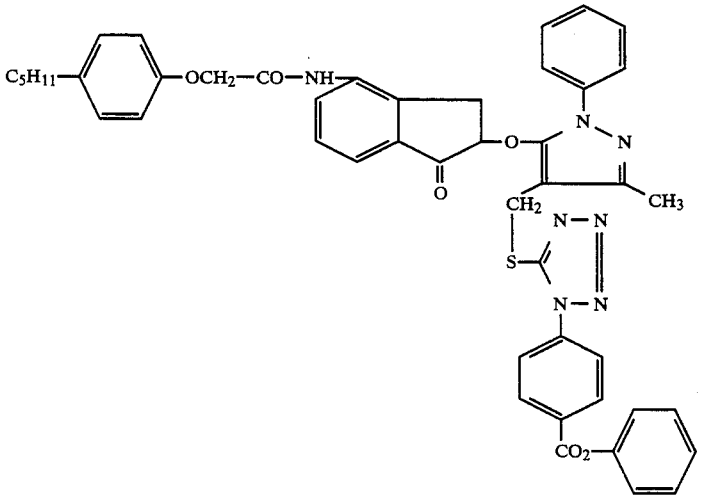
Cpd-17
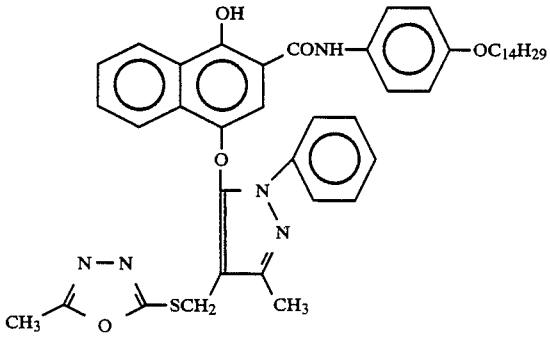
Cpd-18
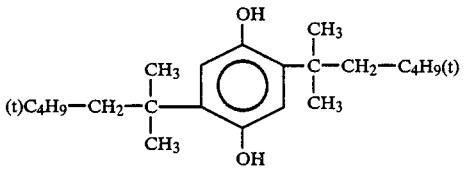
Cpd-19
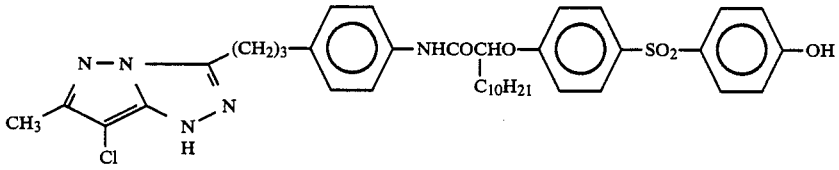

-continued
Cpd-20
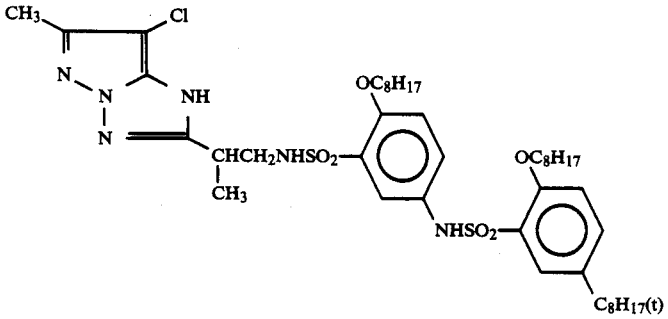
Cpd-21
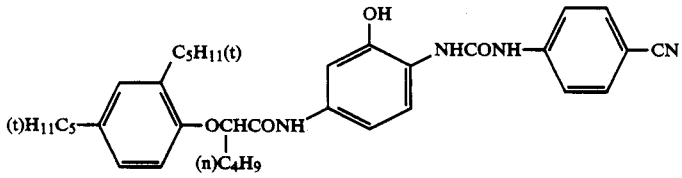
Cpd-22
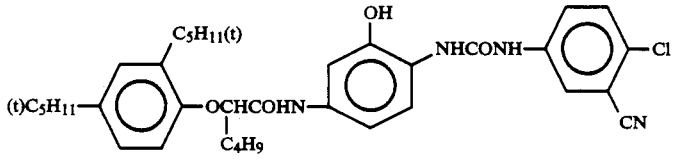
Cpd-23
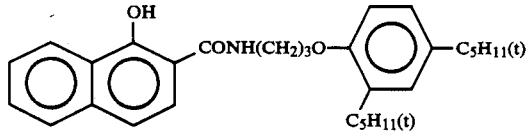
Cpd-24
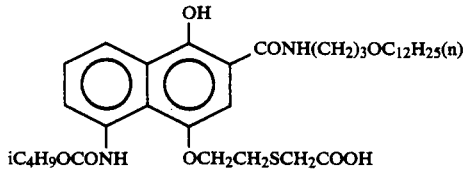
Cpd-25
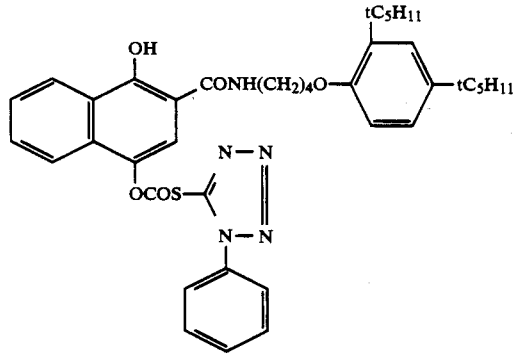
Cpd-26
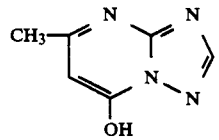

-continued
Cpd-27
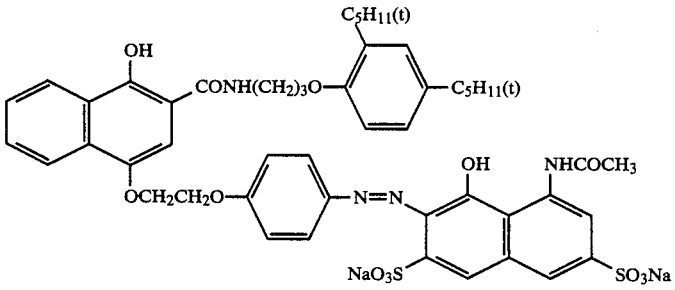
Cpd-28
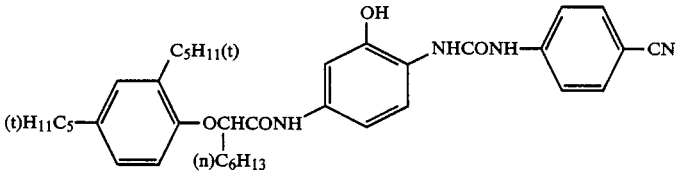
Cpd-29
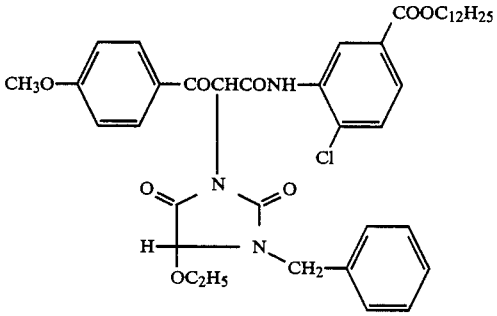
SD-4
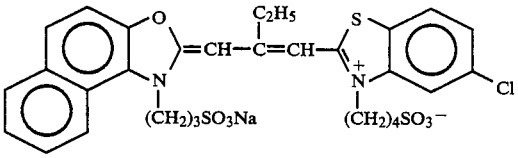
SD-5
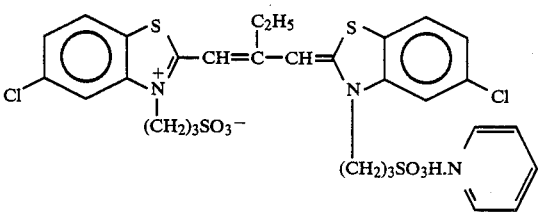
SD-6
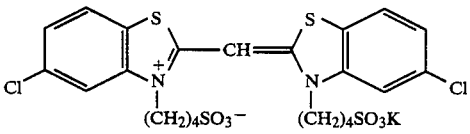
SD-7
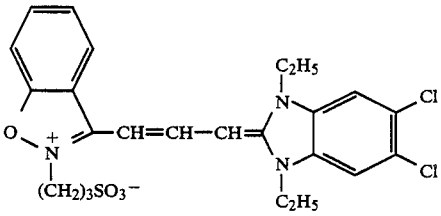

-continued

SD-8

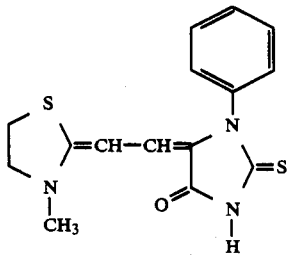

UV-1

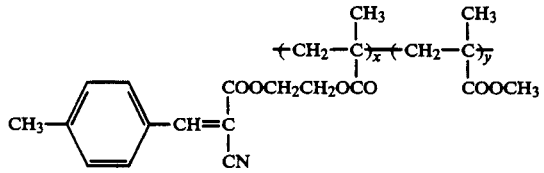

x/y = 7/3 weight ratio

UV-2

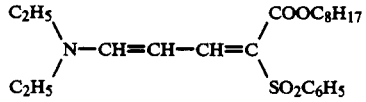

Dibutyl phthalate — Oil-2

Bis phthalate(2-ethylhexyl) — Oil-3

S-1

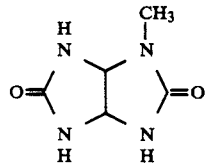

Cpd-10

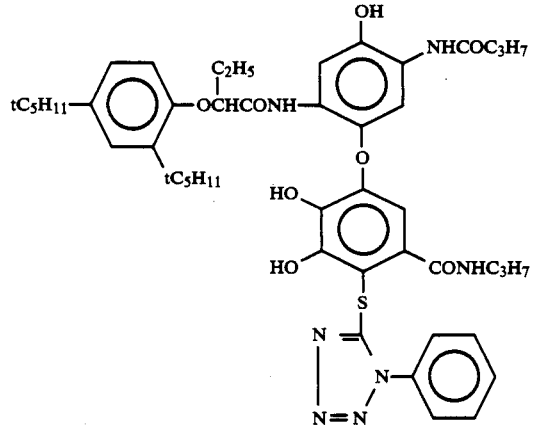

Cpd-11

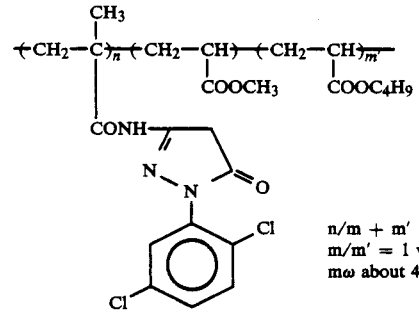

n/m + m' = 1
m/m' = 1 weight ratio
mω about 40,000

The thus prepared sample was named sample 301. Samples 302 to 314 were each prepared in the same manner as that for preparation of sample 301 using the same composition with sample 301 except of changing the sensitizing dyes for those listed in Table 3.

Each of these photographic elements was exposed to light with an exposure amount of 25 CMS using a tungsten light source whose color temperature had been adjusted to 4800° K. Then, each element was subjected to developing process according to the same steps as in Example 2 except that color development time was made to be 3 minutes and 15 seconds.

The results are shown in Table 3 using fog value and sensitivity value of fresh performance (immediately after preparation of samples) as standard, respectively Further, each of samples 301 to 314 was preserved for 3 days at 50° C. under 80% RH, and then similarly, exposed to light, developed and measured for fog and sensitivity. The results are also shown in Table 3.

0.2 g/m² Cpd-36, 0.05 g/m² Cpd-37 and 0.12 cc/m² Oil-1

The 4th layer (The 2nd red-sensitive emulsion layer)

Gelatin layer (dry film thickness 2.5 μm containing 0.8 g/m² in terms of silver amount of monodispersed silver iodobromide emulsion spectrally sensitized with 1.6 mg/m² SD-13 and 0.06 mg/m² SD-14 (iodine content 2.5 mole %, tetradecahedron, average grain size 0.55 μm), 0.55 g/m² Cpd-36, 0.14 g/m² Cpd-37 and 0.33 cc/m² Oil-2

The 5th layer (Intermediate layer)

Gelatin layer (dry film thickness 1 μm) containing 0.1 g/m² H-1 and 0.1 cc/m² Oil-1

The 6th layer (The 1st green-sensitive emulsion layer)

TABLE 3

| | The 6th layer sensitizing dye | | | | The 7th layer sensitizing dye | | | | The 9th layer sensitizing dye | | Fresh preformance | | After preservation for 3 days (50° C., 80% RH) | |
|---|---|---|---|---|---|---|---|---|---|---|---|---|---|---|
| Sample No. | Species | Amount mol/mol Ag | Species | Amount mol/mol Ag | Species | Amount mol/mol Ag | Species | Amount mol/mol Ag | Species | Amount mol/mol Ag | Fog | Relative sensitivity | Fog | Relative sensitivity |
| 301 (p.i.) | I-7 | 3.5 × $10^{-4}$ | III-10 | 2.5 × $10^{-4}$ | I-7 | 3.5 × $10^{-4}$ | III-10 | 2.5 × $10^{-4}$ | I-7 | 8 × $10^{-4}$ | ±0 (standard of fog) | 100 (standard of sensitivity) | +0.02 | 95 |
| 302 (p.i.) | " | 3.5 × $10^{-4}$ | " | 2.5 × $10^{-4}$ | " | 3.5 × $10^{-4}$ | III-10 | 2.5 × $10^{-4}$ | I-19 | 8 × $10^{-4}$ | −0.01 | 99 | +0.01 | 93 |
| 303 (p.i.) | I-19 | 3.5 × $10^{-4}$ | " | 2.5 × $10^{-4}$ | I-19 | 3.5 × $10^{-4}$ | III-10 | 2.5 × $10^{-4}$ | I-7 | 8 × $10^{-4}$ | +0.01 | 99 | +0.02 | 92 |
| 304 (p.i.) | I-5 | 3.5 × $10^{-4}$ | " | 2.5 × $10^{-4}$ | I-5 | 3.5 × $10^{-4}$ | III-10 | 2.5 × $10^{-4}$ | " | 8 × $10^{-4}$ | +0.01 | 101 | +0.02 | 95 |
| 305 (c.e.) | I-7 | 3.5 × $10^{-4}$ | " | 2.5 × $10^{-4}$ | I-7 | 3.5 × $10^{-4}$ | III-10 | 2.5 × $10^{-4}$ | SD-1 | 8 × $10^{-4}$ | +0.10 | 102 | +0.25 | 78 |
| 306 (c.e.) | " | 3.5 × $10^{-4}$ | " | 2.5 × $10^{-4}$ | " | 3.5 × $10^{-4}$ | III-10 | 2.5 × $10^{-4}$ | SD-7 | 8 × $10^{-4}$ | +0.05 | 86 | +0.08 | 66 |
| 307 (c.e.) | " | 3.5 × $10^{-4}$ | " | 2.5 × $10^{-4}$ | " | 3.5 × $10^{-4}$ | III-10 | 2.5 × $10^{-4}$ | SD-2 | 8 × $10^{-4}$ | +0.13 | 98 | +0.40 | 70 |
| 308 (c.e.) | " | 3.5 × $10^{-4}$ | " | 2.5 × $10^{-4}$ | " | 3.5 × $10^{-4}$ | III-10 | 2.5 × $10^{-4}$ | SD-8 | 8 × $10^{-4}$ | +0.04 | 90 | +0.09 | 72 |
| 309 (c.e.) | " | 3.5 × $10^{-4}$ | " | 2.5 × $10^{-4}$ | " | 3.5 × $10^{-4}$ | III-10 | 2.5 × $10^{-4}$ | SD-3 | 8 × $10^{-4}$ | +0.02 | 88 | +0.07 | 69 |
| 310 (c.e.) | SD-1 | 3.5 × $10^{-4}$ | " | 2.5 × $10^{-4}$ | SD-1 | 3.5 × $10^{-4}$ | III-10 | 2.5 × $10^{-4}$ | I-7 | 8 × $10^{-4}$ | +0.14 | 103 | +0.30 | 80 |
| 311 (c.e.) | SD-7 | 3.5 × $10^{-4}$ | " | 2.5 × $10^{-4}$ | SD-7 | 3.5 × $10^{-4}$ | III-10 | 2.5 × $10^{-4}$ | " | 8 × $10^{-4}$ | +0.07 | 86 | +0.10 | 67 |
| 312 (c.e.) | SD-2 | 3.5 × $10^{-4}$ | " | 2.5 × $10^{-4}$ | SD-2 | 3.5 × $10^{-4}$ | III-10 | 2.5 × $10^{-4}$ | " | 8 × $10^{-4}$ | +0.18 | 95 | +0.46 | 63 |
| 313 (c.e.) | SD-8 | 3.5 × $10^{-4}$ | " | 2.5 × $10^{-4}$ | SD-8 | 3.5 × $10^{-4}$ | III-10 | 2.5 × $10^{-4}$ | " | 8 × $10^{-4}$ | +0.07 | 89 | +0.12 | 71 |
| 314 (c.e.) | SD-3 | 3.5 × $10^{-4}$ | " | 2.5 × $10^{-4}$ | SD-3 | 3.5 × $10^{-4}$ | III-10 | 2.5 × $10^{-4}$ | " | 8 × $10^{-4}$ | +0.03 | 86 | +0.09 | 63 |

EXAMPLE 4

Multi-layered color light-sensitive material, which is herein referred to as sample 401, was prepared by providing each of the layers having the following compositions on a cellulose triacetate film support which had been undercoated.

The 1st layer (Antihalation layer)

Gelatin layer (dry film thickness 2 μm) containing 0.25 g/m² black colloidal silver, 0.04 g/m² UV-3, 0.1 g/m² UV-4, 0.1 g/m² UV-5 and 0.1 cc/m² Oil-2

The 2nd layer (Intermediate layer)

Gelatin layer (dry film thickness 1 μm) containing 0.05 g/m² H-1 and 0.05 cc/m² Oil-1

The 3rd layer (The 1st red-sensitive emulsion layer)

Gelatin layer (dry film thickness 1 μm) containing 0.5 g/m² in terms of silver amount of monodispersed silver iodobromide emulsion spectrally sensitized with 1.4 mg/m² SD-13 and 0.06 mg/m² SD-14 (iodine content 4 mole %, cube, average grain size 0.3 μm), 0.2 g/m² Cpd-36, 0.05 g/m² Cpd-37 and 0.12 cc/m² Oil-1

The 4th layer (The 2nd red-sensitive emulsion layer)

Gelatin layer (dry film thickness 2.5 μm containing 0.8 g/m² in terms of silver amount of monodispersed silver iodobromide emulsion spectrally sensitized with 1.6 mg/m² SD-13 and 0.06 mg/m² SD-14 (iodine content 2.5 mole %, tetradecahedron, average grain size 0.55 μm), 0.55 g/m² Cpd-36, 0.14 g/m² Cpd-37 and 0.33 cc/m² Oil-2

The 5th layer (Intermediate layer)

Gelatin layer (dry film thickness 1 μm) containing 0.1 g/m² H-1 and 0.1 cc/m² Oil-1

The 6th layer (The 1st green-sensitive emulsion layer)

Gelatin layer (dry film thickness 1 μm) containing 0.7 g/m² in terms of silver amount of silver iodobromide emulsion spectrally sensitized with 2.3 mg/m² II-3, 1.5 mg/m² I-7 and 1.0 mg/m² III-10 (iodine content 3 mole %, average grain size 0.3 μm , 0.35 g/m² Cpd-20 and 0.26 cc/m² Oil-1

The 7th layer (The 2nd green-sensitive emulsion layer)

Gelatin layer (dry film thickness 2.5 μm) containing 0.7 g/m² in terms of silver amount of tabular silver iodobromide emulsion spectrally sensitized with 0.8 mg/m² II-3, 0.6 mg/m² I-7 and 0.4 mg/m² III-10 (iodine content 2.5 mole %; grains having a diameter/thickness ratio of 5 or more occupying 50% of projected area of all the grains; average grain thickness 0.10 μm), 0.25 g/m² Cpd-38 and 0.05 cc/m² Oil-1

The 8th layer (Intermediate layer)

Gelatin layer (dry film thickness 1 μm) containing 0.05 g/m² H-1 and 0.1 g/m² Oil-1

The 9th layer (Yellow filter layer)

Gelatin layer (dry film thickness 1 μm) containing 0.1 g/m² yellow colloidal silver, 0.02 g/m² H-1, 0.03 g/m² Cpd-41 and 0.04 cc/m² Oil-1

The 10th layer (The 1st blue-sensitive emulsion layer)

Gelatin layer (dry film thickness 1.5 μm) containing 0.6 g/m² in terms of silver amount of silver iodobromide emulsion spectrally sensitized 1.0 mg/m² SD-15 (iodine content 2.5 mole %, average grain size 0.7 μm), 0.5 g/m² Cpd-39 and 0.1 cc/m² Oil-1

The 11th layer (The 2nd blue-sensitive emulsion layer

Gelatin layer (dry film thickness 3 μm) containing 1.1 g/m² in terms of silver amount of tabular silver iodobromide emulsion spectrally sensitized with 1.7 mg/m² SD-15 (iodine content 2.5 mole %; grains having a diameter/thickness ratio of 5 or more occupying 50% of projected area of all the grains; average grain thickness 0.13 μm), 1.2 g/m² Cpd-39 and 0.23 cc/m² Oil-1

The 12th layer (The 1st protective layer)

Gelatin layer (dry film thickness 2 μm) containing 0.02 g/m² UV-3, 0.03 g/m² UV-4, 0.03 g/m² UV-5, 0.2 g/m² UV-6 and 0.28 cc/m² Oil-2

The 13th layer (The 2nd protective layer)

Gelatin layer (dry film thickness 0.8 μm) containing 0.1 g/m² in terms of silver of fine grain silver iodobromide emulsion as superficially fogged (iodine content 1 mole %, average grain size 0.06 μm) and polymethyl methacrylate grains (average grain size 1.5 μm)

Besides the above components, a gelatin hardening agent H-3 and a surfactant were added to each of the above layers.

Compounds used for preparation of the sample are shown below.

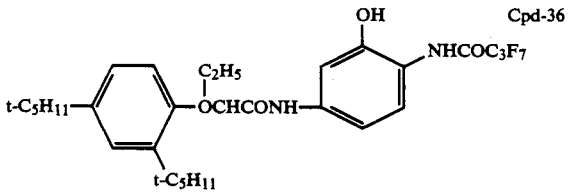

Cpd-36

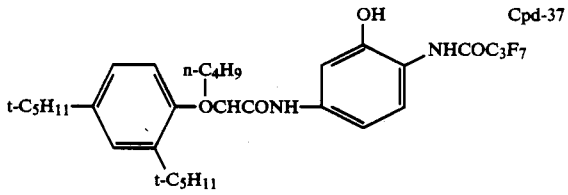

Cpd-37

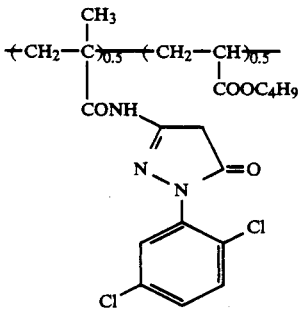

Cpd-38

-continued

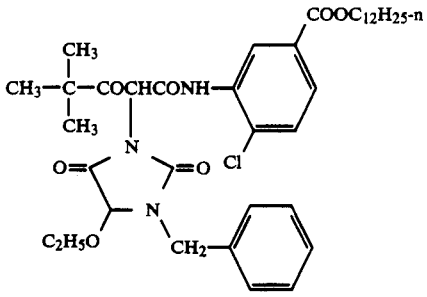

Cpd-39

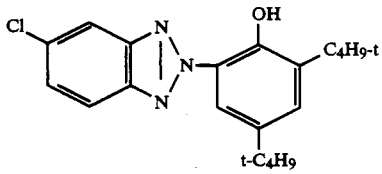

UV-3

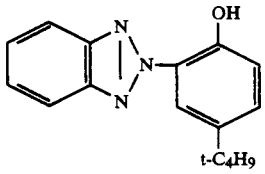

UV-4

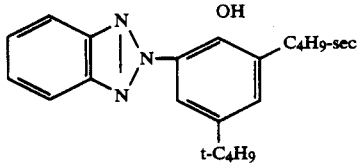

UV-5

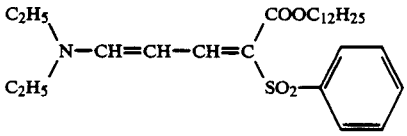

UV-6

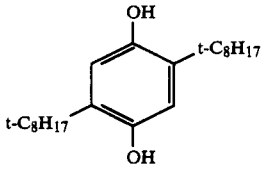

Cpd-40

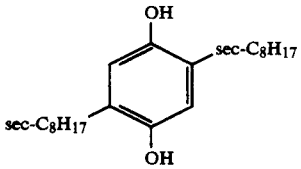

Cpd-41

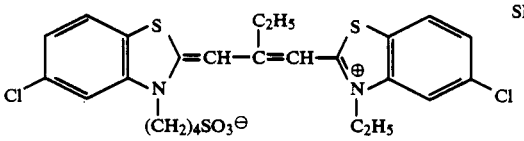

SD-13

-continued

SD-14

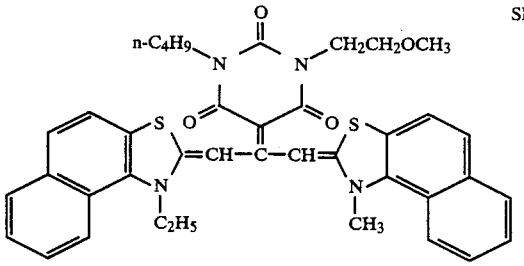

SD-15

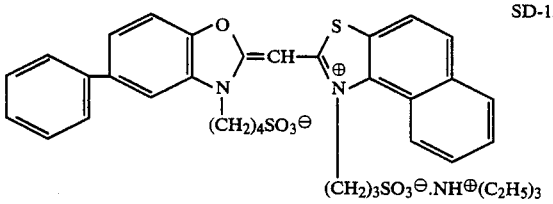

The thus prepared sample was named sample 401. Samples 402 to 408 were each prepared in the same manner as that for preparation of sample 401 using the same composition with sample 401 except of changing the sensitizing dye I-7 for those listed in Table 4.

Each of these photographic elements as such or after preservation under the same condition as in Example 3 was exposed to light, followed by the following process, and then measured for fog and sensitivity. The results are shown in Table 4.

In this connection, extent of fog of each sample of fresh performance or after the preservation was relatively expressed by measuring maximum color density of each sample after color development and comparing it with that of sample 401 of fresh performance. Lowering of relative value in comparison with the standard value shows increase of fog.

| Process steps | | |
|---|---|---|
| Step | Time | Temperature |
| First development | 6 minutes | 38° C. |
| Water washing | 2 minutes | " |
| Reversal | 2 minutes | " |
| Color development | 6 minutes | " |
| Adjustment | 2 minutes | " |
| Bleaching | 6 minutes | " |
| Fixing | 4 minutes | " |
| Water washing | 4 minutes | " |
| Stabilization | 1 minute | Ambient temperature |
| Drying | | |

Compositions of the used process solutions are as follows.

| The first developing solution | |
|---|---|
| Water | 700 ml |
| Pentasodium nitrilo-N,N,N-trimethylenephosphonate | 2 g |
| Sodium sulfite | 20 g |
| Hydroquinone monophosphate | 30 g |

-continued

| | |
|---|---|
| Sodium carbonate monohydrate | 30 g |
| 1-Phenyl-4-methyl-4-hydroxymethyl-3-pyrazolidone | 2 g |
| Potassium bromide | 2.5 g |
| Potassium thiocyanate | 1.2 g |
| Potassium iodide (0.1% solution) | 2 ml |
| Water to | 1000 ml |
| Reversal solution | |
| Water | 700 ml |
| Pentasodium nitrilo-N,N,N-trimethylenephosphonate | 3 g |
| Tin (II) chloride dihydrate | 1 g |
| p-Aminophenol | 0.1 g |
| Potassium hydroxide | 8 g |
| Glacial acetic acid | 15 ml |
| Water to | 1000 ml |
| Color developing solution | |
| Water | 700 ml |
| Pentasodium nitrilo-N,N,N-trimethylenephosphonate | 3 g |
| Sodium sulfite | 7 g |
| Sodium tertiary phosphate dodecahydrate | 36 g |
| Potassium bromide | 1 g |
| Potassium iodide (0.1% solution) | 90 ml |
| Sodium hydroxide | 3 g |
| Citrazinic acid | 1.5 g |
| N-Ethyl-N-β-methanesulfonamidoethyl)-3-methyl-4-aminoaniline sulfate | 11 g |
| 3,6-Dithiaoctane-1,8-diol | 1 g |
| Water to | 1000 ml |
| Conditioning solution | |
| Water | 700 ml |
| Sodium sulfite | 12 g |
| Disodium ethylenediaminetetraacetate dihydrate | 8 g |
| Thioglycerine | 0.4 ml |
| Glacial acetic acid | 3 ml |
| Water to | 1000 ml |
| Bleaching solution | |
| Water | 800 ml |
| Disodium ethylenediaminetetraacetate dihydrate | 2 g |
| Ammonium (ethylenediaminetetraacetato) iron (III) dihydrate | 120 g |
| Potassium bromide | 100 g |
| Water to | 1000 ml |
| Fixing solution | |
| Water | 800 ml |
| Sodium thiosulfate | 80.0 g |
| Sodium sulfite | 5.0 g |
| Sodium bisulfite | 5.0 g |
| Water to | 1000 ml |
| Stabilizing solution | |
| Water | 800 ml |
| Formalin (37 weight %) | 5.0 ml |
| FUJI DRIWELL (a surfactant manufactured by FUJI PHOTO FILM CO., LTD.) | 5.0 ml |
| Water to | 1000 ml |

Similar results were obtained when water washing after fixing was carried out using the following water washing solution in place of water.

| Water washing solution | |
|---|---|
| Disodium ethylenediaminetetraacetate dihydrate | 0.4 g |
| Water to | 1 l |
| With sodium hydroxide | pH 7.0 |

TABLE 4

| Sample No. | The 6th layer sensitizing dye Species | Amount mg/m² | The 7th layer sensitizing dye Species | Amount mg/m² | Fresh performance Max. color density | Relative sensitivity | After preservation for 3 days (50° C., 80% RN) Max. color density | Relative sensitivity |
|---|---|---|---|---|---|---|---|---|
| 401 (p.i.) | I-7 | 1.5 | I-7 | 0.6 | ±0 (standard of max. color density) | 100 (standard of sensitivity) | −0.05 | 95 |
| 402 (p.i.) | I-19 | 1.5 | I-19 | 0.6 | ±0 | 99 | −0.06 | 95 |
| 403 (p.i.) | I-5 | 1.5 | I-5 | 0.6 | −0.02 | 102 | −0.07 | 97 |
| 404 (c.e.) | SD-1 | 1.5 | SD-1 | 0.6 | −0.25 | 103 | −0.43 | 75 |
| 405 (c.e.) | SD-7 | 1.5 | SD-7 | 0.6 | −0.15 | 91 | −0.25 | 66 |
| 406 (c.e.) | SD-2 | 1.5 | SD-2 | 0.6 | −0.32 | 95 | −0.49 | 63 |
| 407 (c.e.) | SD-8 | 1.5 | SD-8 | 0.6 | −0.15 | 90 | −0.23 | 67 |
| 408 (c.e.) | SD-3 | 1.5 | SD-3 | 0.6 | −0.08 | 83 | −0.20 | 65 |

EXAMPLE 5

Each of the following 1st to 7th layers was applied on a paper support, both surfaces of which had been laminated with polyethylene to prepare color light-sensitive material samples 501 to 508. Polyethylene on the surface where the 1st layer was applied contains titanium dioxide and a trace amount of ultramarine.

(Constitution of light-sensitive layer)

Figure corresponding to each component means a coated amount represented by a unit of g/m², and means a coated amount in terms of silver amount for silver halide.

| | |
|---|---|
| **The 1st layer (Blue-sensitive layer)** | |
| Silver chlorobromide emulsion (Silver bromide 80 mole %) | 0.30 |
| Yellow coupler Cpd-42 | 0.70 |
| Oil-6 | 0.15 |
| Gelatin | 0.20 |
| **The 2nd layer (Intermediate layer)** | |
| Gelatin | 0.90 |
| Di-t-octylhydroquinone | 0.05 |
| Oil-2 | 0.10 |
| **The 3rd layer (Green-sensitive layer)** | |
| Refer to Table 6 | |
| **The 4th layer (Ultraviolet absorptive intermediate layer)** | |
| Ultraviolet absorber (UV-3/UV-7/UV-5) | 0.06/0.25/0.25 |
| Oil-6 | 0.20 |
| Gelatin | 1.5 |
| **The 5th layer (Red-sensitive layer)** | |
| Silver chlorobromide emulsion (Silver bromide 70 mole %) | 0.20 |
| Cyan coupler (Cpd-43/Cpd-44) | 0.2/0.2 |
| Coupler solvent (Oil-6/Oil-2) | 0.10/0.20 |
| Gelatin | 0.9 |
| **The 6th layer (Ultraviolet absorptive intermediate layer)** | |
| Ultraviolet absorber (UV-3/UV-7/UV-5) | 0.06/0.25/0.25 |
| Oil-2 | 0.20 |
| Gelatin | 1.5 |
| **The 7th layer (Protective layer)** | |
| Hardening agent H-2 | 0.28 |
| Gelatin | 1.5 |

Cpd-42

-continued

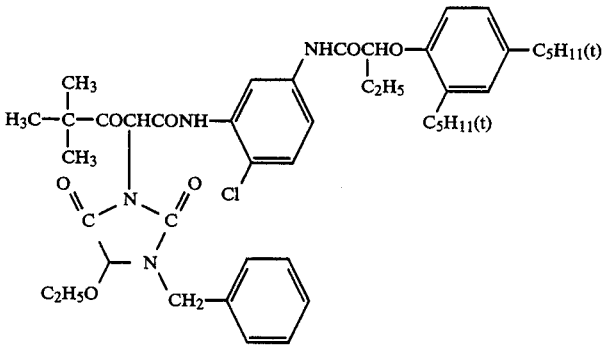

Oil-6
$(C_9H_{19}O)_3-P=O$

UV-7

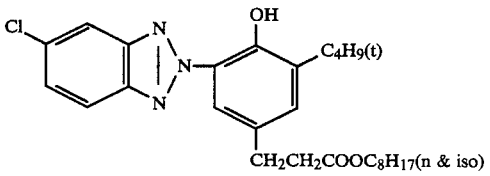

Cpd-43

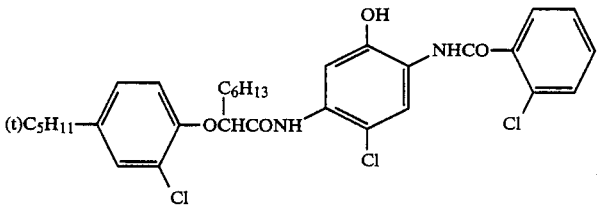

Cpd 44

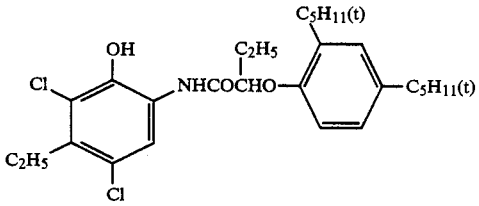

H-2:

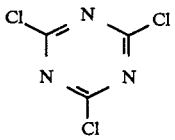

The following compounds were used as spectrally sensitizing dyes for the blue-sensitive emulsion layer and red-sensitive emulsion layer, respectively:

Blue-sensitive emulsion layer; SD-6
(Added in an amount of $2\times10^{-4}$ moles per 1 mole of the silver halide)

Red-sensitive emulsion layer;

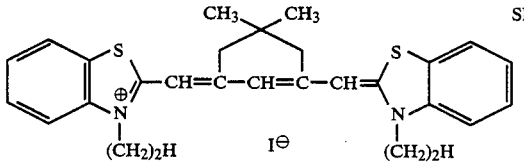

SD-16

-continued
Red-sensitive emulsion layer;

(Added in an amount of $2.5\times10^{-4}$ moles per 1 mole of the silver halide)

The following dyes were used as irradiation inhibiting dyes for respective emulsion layers.

Green-sensitive emulsion layer

-continued

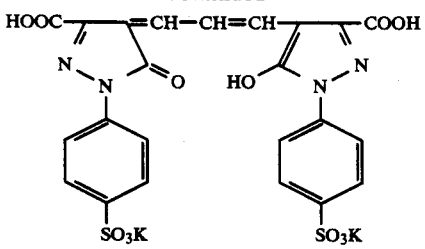

Red-sensitive emulsion layer

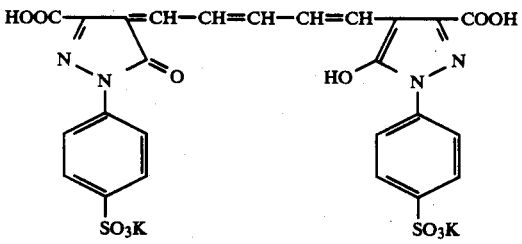

The green-sensitive emulsion layer contains a silver chlorobromide emulsion (silver chloride content 30 mole %) comprising monodispersed cubic grains having an average grain size of 0.4 μm, and chemical sensitization was carried out with the addition of $2.0\times10^{-5}$ moles of sodium thiosulfate per 1 mole of the silver halide. The emulsion layer further contains 300 mg of 4-hydroxy-6-methyl-(1,3,3a,7)-tetrazaindene per 1 mole of the silver halide. Combinations of spectrally sensitizing dyes used were shown in Table 6.

Further, 100 g of a magenta dye-forming coupler, Cpd-20 together with 50 g of a fading inhibitor, Cpd-45 were dissolved in a mixed solvent of 200 ml of a solvent Oil-7 and 100 ml of ethyl acetate. This solution was emulsified and dispersed in 200 g of an aqueous 10% gelatin solution containing 8.0 g sodium dodecylbenzenesulfonate to prepare an emulsified dispersion, which was then used.

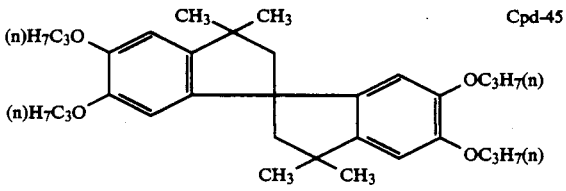

Cpd-45

$(C_8H_{17}O)_3-P=O$ Oil-7

The coated amount of the emulsion for the 3rd layer was 200 mg/m² in terms of silver amount.

| Emulsified dispersion | | |
|---|---|---|
| Emulsified emulsion 2 | | |
| Magenta coupler | Cpd-20 | 600 mg/m² |
| Fading inhibitor | Cpd-45 | 300 mg/m² |
| Coupler solvent | Oil-7 | 1.20 ml/m² |
| (Gelatin was added to the coating solution so that the resulting applied gelatin amount becomes 1800 mg/m²) | | |

In order to confirm preservability of these coated samples, they were examined for change of photographic performance after preservation for 4 weeks in a state of 50° C. and 45% RH as a forced test. The samples before and after preservation were each subjected to gradation exposure to light for sensitometry using an enlarging machine (FUJI COLOR HEAD 690 manufactured by FUJI PHOTO FILM CO., LTD.) through a green filter, and then subjected to developing process comprising the following process steps.

| | Temperature | Time |
|---|---|---|
| Process step | | |
| Developing solution | 33° C. | 3.5 minutes |
| Bleach-fixing solution | 33° C. | 1.5 minutes |
| Water washing | 28–35° C. | 3.0 minutes |
| Developing solution | | |
| Diethylenetriaminepentaacetic acid | | 1.0 g |
| Benzyl alcohol | | 15 ml |
| Diethylene glycol | | 10 ml |
| $Na_2SO_3$ | | 2.0 g |
| KBr | | 0.5 g |
| Hydroxylamine sulfate | | 3.0 g |
| 4-Amino-3-methyl-N-ethyl-N-[β-(methanesulfonamido)ethyl]-p-phenylenediamine sulfate | | 5.0 g |
| $Na_2CO_3$ monohydrate | | 30 g |
| Water to | | 1 l |
| | | (pH 10.1) |
| Bleach-fixing solution | | |
| Ammonium thiosulfate (54 wt %) | | 150 ml |
| $Na_2SO_3$ | | 15 g |
| $NH_4[Fe(EDTA)]$ | | 55 g |
| EDTA2.2Na | | 4 g |
| Water to | | 1 l |
| | | (pH 6.9) |

Color density of each sample after the above processing was measured, and sensitivity change after the preservation based on fresh performance, and fog density of each sample were determined. The results are shown in Table 5.

TABLE 5

| Sample No. | The 3rd layer sensitizing dye Species | Amount | Species | Amount | Fresh performance Fog | Relative Sensitivity | After preservation for 4 weeks (50° C., 45% RH) Fog | Relative Sensitivity |
|---|---|---|---|---|---|---|---|---|
| 501 (p.i.) | I-5 | $1.6\times10^{-4}$ mol/mol Ag | III-10 | $3.2\times10^{-4}$ mol/mol Ag | ±0 (Standard of fog) | 100 (Standard of sensitivity) | +0.04 | 97 |
| 502 (p.i.) | I-7 | $1.7\times10^{-4}$ mol/mol Ag | " | $3.2\times10^{-4}$ mol/mol Ag | +0.02 | 96 | +0.04 | 95 |
| 504 (c.e.) | SD-1 | $1.7\times10^{-4}$ mol/mol Ag | " | $3.2\times10^{-4}$ mol/mol Ag | +0.12 | 103 | +0.25 | 88 |
| 505 (c.e.) | SD-7 | $1.7\times10^{-4}$ mol/mol Ag | " | $3.2\times10^{-4}$ mol/mol Ag | +0.05 | 90 | +0.12 | 70 |
| 506 (c.e.) | SD-2 | $1.7\times10^{-4}$ mol/mol Ag | " | $3.2\times10^{-4}$ mol/mol Ag | +0.15 | 97 | +0.38 | 58 |

TABLE 5-continued

| Sample No. | The 3rd layer sensitizing dye Species | Amount | Species | Amount | Fresh performance Fog | Relative Sensitivity | After preservation for 4 weeks (50° C., 45% RH) Fog | Relative Sensitivity |
|---|---|---|---|---|---|---|---|---|
| 507 (c.e.) | SD-8 | $1.7 \times 10^{-4}$ mol/mol Ag | " | $3.2 \times 10^{-4}$ mol/mol Ag | +0.06 | 88 | +0.10 | 65 |
| 508 (c.e.) | SD-3 | $1.7 \times 10^{-4}$ mol/mol Ag | " | $3.2 \times 10^{-4}$ mol/mol Ag | +0.03 | 86 | +0.13 | 63 |

EXAMPLE 6

Preparation of sample 601

Multi-layered color light-sensitive material 601 was prepared by providing each of the layers having the following compositions on a cellulose triacetate film support which had been undercoated.

(Composition of light-sensitive layer)

Figure corresponding to each component means a coated amount represented by a unit of g/m$^2$, and means a coated amount in terms of silver amount for silver halide. However, as for each of the sensitizing dyes, figure corresponding thereto means a coated amount represented by moles per 1 mole of the silver halide in the same layer.

| | |
|---|---|
| The 1st layer (Antihalation layer) | |
| Black colloidal silver | 0.2 |
| Gelatin | 2.6 |
| UV-4 | 0.2 |
| Oil-3 | 0.02 |
| The 2nd layer (Intermediate layer) | |
| Fine grain silver bromide (Average grain size 0.07 μm) | 0.15 |
| Gelatin | 1.0 |
| The 3rd layer (Low-speed red-sensitive emulsion layer) | |
| Monodispersed silver iodobromide emulsion (silver iodide 5.5 mole %, average grain size about 0.3 μm, variation coefficiency with respect to grain size (hereinafter merely referred to variation coefficiency) 19%) | 1.5 |
| Gelatin | 3.0 |
| SD-17 | $2.0 \times 10^{-4}$ |
| SD-5 | $1.0 \times 10^{-4}$ |
| SD-10 | $0.3 \times 10^{-4}$ |
| Cpd-22 | 0.7 |
| Cpd-48 | 0.1 |
| Cpd-17 | 0.02 |
| Cpd-54 | 0.01 |
| Oil-3 | 0.8 |
| Oil-1 | 0.2 |
| Oil-8 | 0.1 |
| The 4th layer (High-speed red-sensitive emulsion layer) | |
| Monodispersed silver iodobromide emulsion (silver iodide 3.5 mole %, average grain size about 0.7 μm, variation coefficiency 18%) | 1.2 |
| Gelatin | 2.5 |
| SD-17 | $3 \times 10^{-4}$ |
| SD-5 | $1.5 \times 10^{-4}$ |
| SD-10 | $0.45 \times 10^{-4}$ |
| Cpd-46 | 0.15 |
| Cpd-47 | 0.05 |
| Cpd-48 | 0.03 |
| Cpd-17 | 0.01 |
| Oil-3 | 0.05 |
| Oil-1 | 0.3 |
| The 5th layer (Intermediate layer) | |
| Gelatin | 0.8 |

-continued

| | |
|---|---|
| Cpd-56 | 0.05 |
| Oil-2 | 0.01 |
| The 6th layer (Low-speed green-sensitive emulsion layer) | |
| Monodispersed silver iodobromide emulsion (silver iodide 5 mole %, average grain size about 0.3 μm, variation coefficiency 19%) | 0.4 |
| Monodispersed silver iodobromide emulsion (silver iodide 7 mole %, average grain size about 0.5 μm) | 0.8 |
| Gelatin | 3.0 |
| II-3 | $1 \times 10^{-4}$ |
| II-2 | $3 \times 10^{-4}$ |
| III-10 | $1 \times 10^{-4}$ |
| I-4 | $1 \times 10^{-4}$ |
| Cpd-49 | 0.2 |
| CPd-50 | 0.4 |
| Cpd-51 | 0.16 |
| Cpd-53 | 0.05 |
| Oil-1 | 1.2 |
| Oil-8 | 0.05 |
| Oil-9 | 0.01 |
| The 7th layer (High-speed green-sensitive emulsion layer) | |
| Multi-dispersed silver iodobromide emulsion (silver iodide 3.5 mole %, average grain size about 0.8 μm, variation coefficiency 15%) | 0.9 |
| Gelatin | 1.6 |
| II-3 | $0.7 \times 10^{-4}$ |
| II-2 | $2.1 \times 10^{-4}$ |
| III-10 | $0.7 \times 10^{-4}$ |
| I-4 | $0.7 \times 10^{-4}$ |
| Cpd-50 | 0.05 |
| Cpd-51 | 0.04 |
| Cpd-53 | 0.01 |
| Oil-3 | 0.08 |
| Oil-1 | 0.3 |
| Oil-8 | 0.03 |
| The 8th layer (Yellow filter layer) | |
| Yellow colloidal silver | 0.2 |
| Gelatin | 0.9 |
| Cpd-56 | 0.2 |
| Oil-1 | 0.1 |
| The 9th layer (Low-speed blue-sensitive emulsion layer) | |
| Monodispersed silver iodobromide emulsion (silver iodide 6 mole %, average grain size 0.3 μm, variation coefficiency 20%) | 0.4 |
| Monodispersed silver iodobromide emulsion (silver iodide 5 mole %, average grain size 0.6 μm, variation coefficiency 17%) | 0.4 |
| Gelatin | 2.9 |
| SD-18 | $1 \times 10^{-4}$ |
| SD-19 | $1 \times 10^{-4}$ |
| Cpd-52 | 1.2 |
| Cpd-17 | 0.05 |
| Oil-1 | 0.4 |
| Oil-8 | 0.1 |
| The 10th layer (High-speed blue-sensitive emulsion layer) | |

-continued

| | |
|---|---|
| Monodispersed silver iodobromide emulsion (silver iodide 6 mole %, average grain size 1.5 μm, variation coefficiency 14%) | 0.5 |
| Gelatin | 2.2 |
| SD-18 | $5 \times 10^{-5}$ |
| SD-19 | $5 \times 10^{-5}$ |
| Cpd-52 | 0.4 |
| Cpd-17 | 0.02 |
| Oil-1 | 0.1 |
| The 11th layer (The 1st protective layer) | |
| Gelatin | 1.0 |
| UV-4 | 0.1 |
| UV-8 | 0.1 |
| UV-3 | 0.1 |
| Cpd-55 | 0.1 |
| Oil-3 | 0.1 |
| Oil-8 | 0.1 |
| The 12th layer (The 2nd protective layer) | |
| Fine grain silver bromide emulsion (average grain size 0.07 μm) | 0.25 |
| Gelatin | 1.0 |
| Polymethyl methacrylate grains (diameter 1.5 μm) | 0.2 |
| Cpd-58 | 0.5 |

Besides the above components, a surfactant Cpd-57 and a hardening agent H-3 were added to each layer.

SD-17

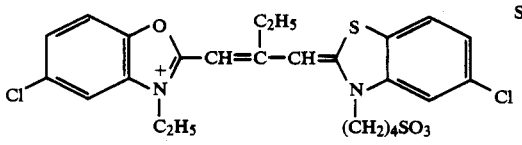

SD-10

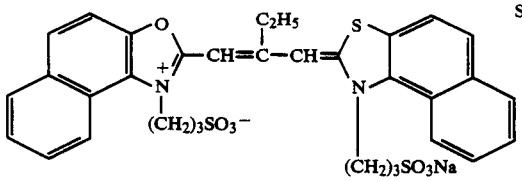

SD-18

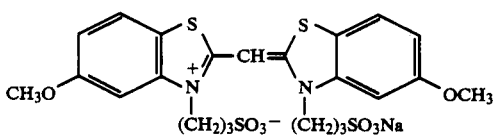

SD-19

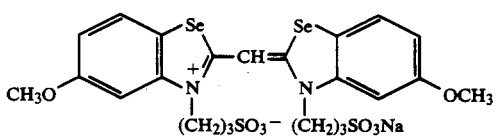

Cpd-46

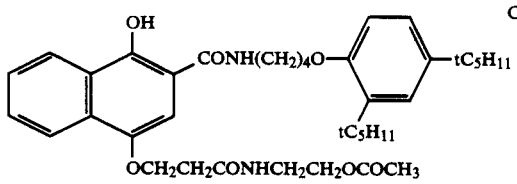

Cpd-47

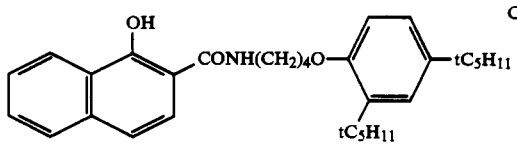

-continued

Cpd-48

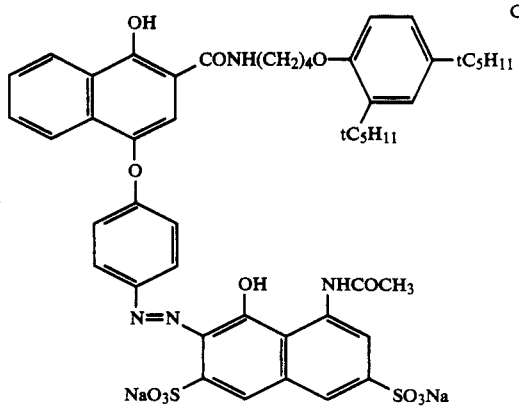

Cpd-49

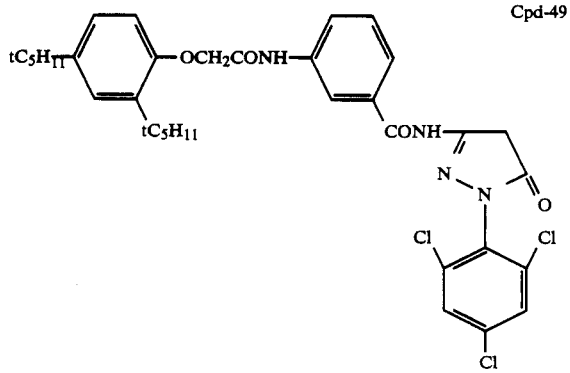

Cpd-50

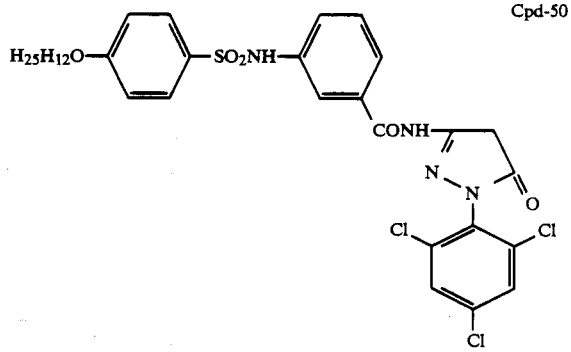

Cpd-51

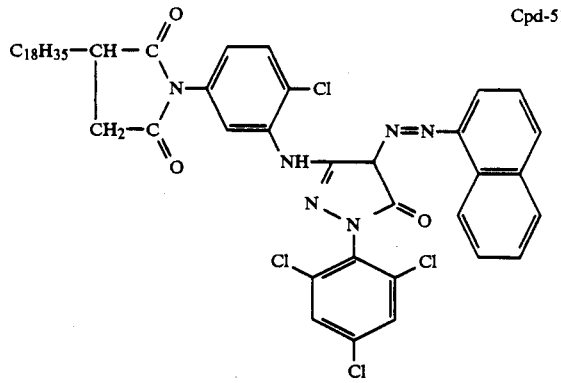

-continued

Cpd-52

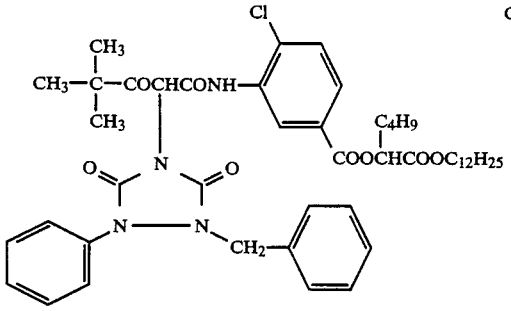

Cpd-53

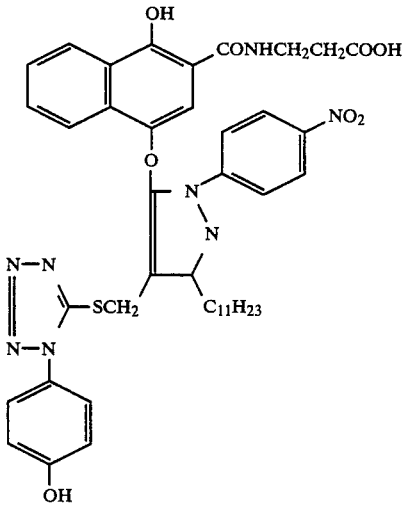

Cpd-54

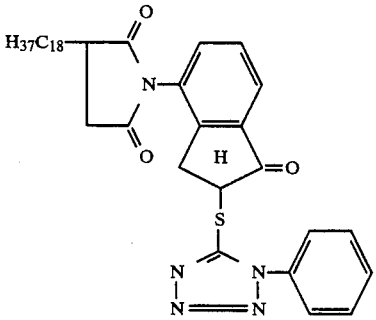

Cpd-56

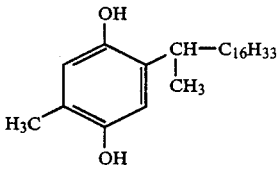

UV-8

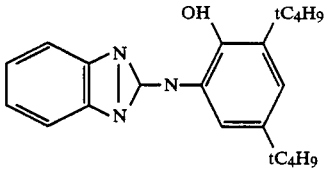

Cpd-55

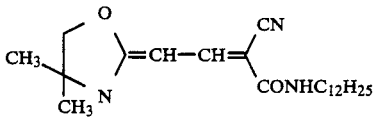

-continued oil-8

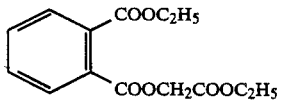

oil-9

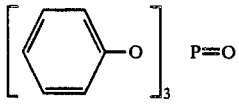

Cpd-57

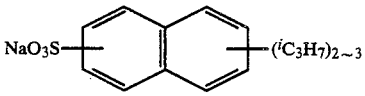

Cpd-58

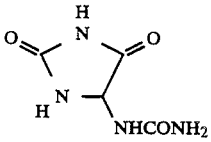

H-3

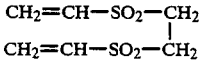

The thus prepared sample was named sample 601. Samples 402 to 408 were similarly prepared using the same composition with sample 601 except that the sensitizing dye I-4 of the 6th and 7th layers was replaced by those described in Table 6.

Each of these photographic elements as such or after preservation under the same condition as in Example 3 was exposed to light, followed by the following process, and then measured for fog and sensitivity. The results are shown in Table 6.

| Process step | Process temperature (°C.) | Process time | Amount of replenisher (ml/24 Exp) |
|---|---|---|---|
| Color development | 38 ± 0.3 | 3'15" | 55 |
| Bleaching | 30–38 | 6'30" | 10 |
| Fixing | 20–35 | 3'15" | 34.5 |
| Rinse 1* | 20–35 | 1'20" | — |
| Rinse 2* | 20–35 | 1'20" | 34.7 |
| Stabilization | 20–35 | 1'20" | 34.5 |
| Drying | 40–60 | 2'50" | |

(*cascade system from rinse 2 to rinse 1)

Processing solutions used are as follows.

| | Tank solution | Replenisher |
|---|---|---|
| Color developing solution | | |
| Diethylenetriamine-pentaacetic acid | 3.0 g | 3.0 g |
| Potassium carbonate | 37 g | 37 g |
| Sodium sulfite | 3.2 g | 4.5 g |
| Potassium bromide | 1.2 g | 0.95 g |
| Hydroxylamine sulfate | 2.7 g | 3.4 g |
| 4-(N-Ethyl-N-β-hydroxyethylamino)-2-methylamiline sulfate | 4.0 g | 5 g |
| Potassium iodide | 5 mg | — |
| Water to | 1 l | 1 l |
| KOH to | pH 10.05 | 10.00 |
| Bleaching solution | | |
| Ammonium bromide | 177 g | 177 g |
| Ammonium (ethylenediaminetetraacetato) iron (III) | 120 g | 120 g |
| Ethylenediamine- | 10 g | 10 g |

-continued

| | Tank solution | Replenisher |
|---|---|---|
| tetraacetic acid | | |
| Ammonia water | 10 ml | — |
| Water to | 1 l | 1 l |
| With KOH/glacial acetic acid | pH 6.0 | 5.7 |
| Fixing solution | | |
| Ammonia thiosulfate (70%) | 180 ml | 260 ml |
| Sodium sulfite | 13 g | 18 g |
| Ethylenediamine-tetraacetic acid | 5 g | 5 g |
| Water to | 1 l | 1 l |
| With KOH/glacial acetic acid | pH 6.75 | 7.0 |
| Rinsing solution (the same formulation between tank solution and replenisher) | | |
| 2-Methyl-4-isothiazolin-3-one | 3 mg | |
| 5-Chloro-2-methyl-4-isothiazolin-3-one | 6 mg | |
| Ethylene glycol | 1.5 ml | |
| Water to | 1 l | |
| Stabilizing solution (the same formulation between tank solution and replenisher) | | |
| Formalin (37%) | 4.0 ml | |
| Ethylene glycol | 2 g | |
| Surfactant | 0.4 g | |

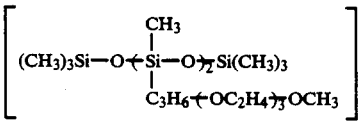

| | |
|---|---|
| Water to | 1 l |

TABLE 6

| Sample No. | The 6th layer sensitizing dye | | The 7th layer sensitizing dye | | Fresh performance Fog | Fresh performance Relative sensitivity | After preservation for 3 days (50° C., 80% RH) Fog | After preservation for 3 days (50° C., 80% RH) Relative sensitivity |
|---|---|---|---|---|---|---|---|---|
| 601 (p.i.) | I-4 | $1 \times 10^{-4}$ mol/mol Ag | I-4 | $0.7 \times 10^{-4}$ mol/mol Ag | ±0 (standard of fog) | 100 (standard of sensitivity) | +0.03 | 95 |
| 602 (p.i) | I-19 | $1 \times 10^{-4}$ | I-19 | $0.7 \times 10^{-4}$ | +0.02 | 98 | ±0 | 95 |
| 603 (p.i) | I-5 | $1 \times 10^{-4}$ | I-5 | $0.7 \times 10^{-4}$ | ±0 | 102 | +0.03 | 94 |
| 604 (c.e) | SD-1 | $1 \times 10^{-4}$ | SD-1 | $0.7 \times 10^{-4}$ | +0.15 | 104 | +0.30 | 82 |
| 605 (c.e) | SD-7 | $1 \times 10^{-4}$ | SD-7 | $0.7 \times 10^{-4}$ | +0.06 | 89 | +0.11 | 69 |
| 606 (c.e) | SD-2 | $1 \times 10^{-4}$ | SD-2 | $0.7 \times 10^{-4}$ | +0.18 | 96 | +0.48 | 62 |
| 607 (c.e) | SD-8 | $1 \times 10^{-4}$ | SD-8 | $0.7 \times 10^{-4}$ | +0.07 | 88 | +0.12 | 68 |
| 608 (c.e) | SD-3 | $1 \times 10^{-4}$ | SD-3 | $0.7 \times 10^{-4}$ | +0.05 | 87 | +0.11 | 64 |

As is seen from the foregoing description, it is possible to increase sensitivity of photographic light-sensitive materials and greatly inhibit increase of fog and lowering of sensitivity thereof during preservation by using in combination a spectrally sensitizing dye of the general formula (I) and a spectrally sensitizing dye of the general formula (III), or by using in combination a spectrally sensitizing dye of the general formula (I), a spectrally sensitizing dye of the general formula (II) and a spectrally sensitizing dye of the general formula (III).

What is claimed is:

1. A silver halide photographic emulsion containing at least one of the compounds represented by the following general formula (I) and at least one of the compounds represented by the following general formula (III):

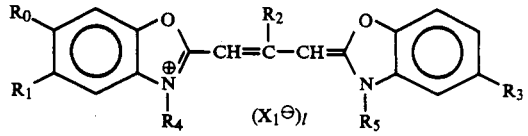

wherein $R_0$ and $R_1$ may be the same or different, and represent hydrogen atoms, unsubstituted or substituted alkyl groups, unsubstituted or substituted aryl groups, unsubstituted or substituted aryloxy groups, halogen atoms, unsubstituted or substituted alkoxycarbonyl groups, unsubstituted or substituted acylamino groups, unsubstituted or substituted acyl groups, cyano groups, unsubstituted or substituted carbamoyl groups, unsubstituted or substituted sulfamoyl groups, carboxyl groups, or unsubstituted or substituted acyloxy groups, provided that $R_0$ and $R_1$ do not represent hydrogen atoms at the same time; $R_2$ represents a hydrogen atom, an unsubstituted or substituted alkyl group, or an unsubstituted or substituted aryl group; $R_3$ represents a branched butyl, branched pentyl, branched hexyl, cyclohexyl, branched octyl, benzyl or phenethyl group, and moreover $R_3$ is required to be a substituent having such L and B that S value is 544 or less in the equation of $$S = 3.536L - 2.661B + 535.4$$

wherein L represents a STERIMOL parameter (its unit is Å), and B represents the smaller value among $B_1 + B_4$ and $B_2 + B_3$ which are each sums of STERIMOL parameters (their units are Å); $X_1\ominus$ represents a counter anion; and l is 0 or 1, and when an inner salt is formed, l is 0;

General formula (III)

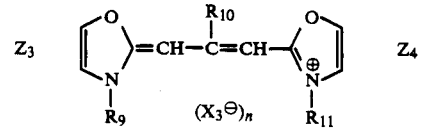

wherein $Z_3$ and $Z_4$ may be the same or different, and represent nonmetal atomic groups necessary for formation of unsubstituted or substituted naphthalene rings; $R_9$ and $R_{11}$ have the same meanings with $R_4$ and $R_5$, respectively; $R_{10}$ has the same meaning with $R_2$; $X_3\ominus$ has the same meaning with $X_1\ominus$; and n has the same meaning with 1.

2. The silver halide photographic emulsion of claim 1 wherein in the definition of $R_0$ and $R_1$, the unsubstituted or substituted alkyl groups, unsubstituted or substituted aryl groups, unsubstituted or substituted aryloxy groups, unsubstituted or substituted alkoxycarbonyl groups, unsubstituted or substituted acyl groups, and unsubstituted or substituted acyloxy groups each have 10 or less carbon atoms; the unsubstituted or substituted acylamino groups each have 8 or less carbon atoms; and the unsubstituted or substituted carbamoyl groups, and unsubstituted or substituted sulfamoyl groups each have 6 or less carbon atoms.

3. The silver halide photographic emulsion of claim 2 wherein in the definition of $R_0$ and $R_1$, the unsubstituted or substituted alkyl groups are methyl, ethyl, propyl, butyl, pentyl, vinylmethyl, cyclohexyl, benzyl, phenethyl, 3-phenylpropyl or trifluoromethyl groups; the unsubstituted or substituted aryl groups are phenyl, 4-methylphenyl, 4-chlorophenyl or naphthyl groups; the unsubstituted or substituted aryloxy groups are phenoxy, 4-methylphenoxy, 4-chlorophenoxy or naphthyloxy groups; the unsubstituted or substituted alkoxycarbonyl groups are methoxycarbonyl, ethoxycarbonyl or benzyloxycarbonyl groups; the unsubstituted or substituted acylamino groups are acetylamino, trifluoroacetylamino, propionylamino or benzoylamino groups; the unsubstituted or substituted acyl groups are acetyl, trifluoroacetyl, propionyl, benzoyl, p-chlorobenzoyl or mesyl groups; the unsubstituted or substituted carbamoyl groups are carbamoyl, N,N-dimethylcarbamoyl or morpholinocarbonyl groups; the unsubstituted or substituted sulfamoyl groups are sulfamoyl, N,N-dimethylsulfamoyl, morpholinosulfonyl or piperidinosulfonyl groups; and the unsubstituted or substituted acyloxy groups are acetyloxy, trifluoroacetyloxy, propionyloxy or benzoyloxy groups.

4. The silver halide photographic emulsion of claim 1 wherein in the definition of $R_2$, the unsubstituted or substituted alkyl group has 4 or less carbon atoms, and the unsubstituted or substituted aryl group has 10 or less carbon atoms.

5. The silver halide photographic emulsion of claim 4 wherein in the definition of $R_2$, the unsubstituted or substituted alkyl group is a methyl, ethyl, propyl, butyl, phenethyl or 3-phenylpropyl; and the unsubstituted or substituted aryl group is a phenyl or p-tolyl group.

6. The silver halide photographic emulsion of claim 1 wherein in the definition of $R_4$ and $R_5$, the unsubstituted or substituted alkyl groups are alkyl groups each having 8 or less carbon atoms or aralkyl groups each having 10 or less carbon atoms; or are alkyl groups each having 6 or less carbon atoms substituted with a substituent selected from the group consisting of a hydroxyl group, a carboxyl group, a sulfo group, a cyano group, a halogen atom, an unsubstituted or substituted alkoxycarbonyl group having 8 or less carbon atoms, an unsubstituted or substituted alkoxy group having 8 or less carbon atoms, an aryloxy group having 8 or less carbon atoms, an acyloxy group having 8 or less carbon atoms, an acyl group having 8 or less carbon atoms, an unsubstituted or substituted carbamoyl group having 6 or less carbon atoms, an unsubstituted or substituted sulfamoyl group having 6 or less carbon atoms, or an unsubstituted or substituted aryl group having 10 or less carbon atoms.

7. The silver halide photographic emulsion of claim 1 wherein in the definition of R4 and R5, the unsubstituted or substituted alkyl groups are methyl, ethyl, propyl, vinylmethyl, butyl, pentyl, hexyl, heptyl, octyl, benzyl, phenethyl or 3-phenylpropyl groups, or are alkyl groups each having 6 or less carbon atoms substituted with a substituent selected from the group consisting of hydroxyl, carboxyl, sulfo, cyano, halo, methoxycarbonyl, ethoxycarbonyl, benzyloxycarbonyl, methoxy, ethoxy, butyloxy, benzyloxy, phenethyloxy, phenoxy, p-tolyloxy, acetyloxy, propionyloxy, benzoyloxy, acetyl, propionyl, benzoyl, 4-fluorobenzoyl, carbamoyl, N,N-dimethylcarbamoyl, morpholinocarbonyl, piperidinocarbonyl, sulfamoyl, N,N-dimethylsulfamoyl, morpholinosulfonyl, piperidinosulfonyl, phenyl, p-fluorophenyl, p-hydroxyphenyl, p-carboxyphenyl and p-sulfophenyl groups.

8. The silver halide photographic emulsion of claim 1 wherein the counter anion represented by $X_1\ominus$ is an inorganic or organic acid anion.

9. The silver halide photographic emulsion of claim 1 wherein the heterocyclic part which is formed containing $Z_3$ or $Z_4$ as expressed as a naphthooxazole is naphtho(1,2-d)oxazole, naphtho(2,1-d)oxazole, naphtho(2,3-d)oxazole, 8-methoxynaphtho(1,2-d)oxazole or 5-acetylaminonaphtho(2,1-d)oxazole.

10. The silver halide photographic emulsion of claim 1 which further contains at least one of the compounds represented by the general formula (II):

General formula (II)

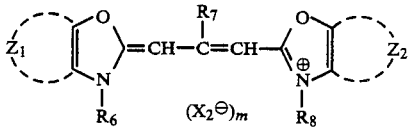

wherein $Z_1$ and $Z_2$ may be the same or different, and represent nonmetal atomic groups necessary for formation of benzene rings or naphthalene rings, provided that $Z_1$ and $Z_2$ do not form naphthalene rings at the same time, and further provided that when $Z_1$ and/or $Z_2$ form benzene rings each having a substituent, the substituent does not represent any of substituents defined as $R_3$; $R_7$ has the same meaning with $R_2$; $R_6$ and $R_8$ have the same meaning with $R_4$ and $R_5$, respectively; $X_2\ominus$ has the same meaning with $X_1\ominus$; and m has the same meaning with 1.

11. The silver halide photographic emulsion of claim 10 wherein the heterocyclic part which is formed containing $Z_1$ or $Z_2$ as expressed as a benzoxazole or naphthooxazole is benzoxazole, 5-chlorobenzoxazole, 5-methylbenzoxazole, 5-bromobenzoxazole, 5-fluorobenzoxazole, 5-phenylbenzoxazole, 5-methoxybenzoxazole, 5-butoxybenzoxazole, 5-nitrobenzoxazole, 5-trifluoromethylbenzoxazole, 5-hydroxybenzoxazole, 5-carboxybenzoxazole, 6-methylbenzoxazole, 6-chlorobenzoxazole, 6-nitrobenzoxazole, 6-methoxybenzoxazole, 6-amylbenzoxazole, 6-hydroxybenzoxazole, 5,6-dimethylbenzoxazole, 4,6-dimethylbenzoxazole, 5-ethoxybenzoxazole, naphtho(2,1-d)oxazole, naphtho(1,2-d)oxazole, naphtho(2,3-d)oxazole or 5-nitronaphtho(2,1-d)oxazole.

12. The silver halide photographic emulsion of claim 1 wherein a molar ratio of the compound of formula (I) to that of formula (II) is 50±20 to 30±0.

13. The silver halide photographic emulsion of claim 1 wherein the silver halide is silver bromide, silver iodobromide, silver iodochlorobromide, silver chlorobromide or silver chloride.

14. The silver halide photographic emulsion of claim 1 which further contains a color-forming coupler.

15. A photographic light-sensitive material which comprises a support having applied thereon the silver halide photographic emulsion of claim 1.

16. The silver halide photographic emulsion of claim 10 wherein a molar ratio of the compounds of formulas (I), (II) and (III) is 50±20:30±10:20±10.

17. The silver halide photographic emulsion of claim 10 wherein the silver halide is silver bromide, silver iodobromide, silver iodochlorobromide, silver chlorobromide or silver chloride.

18. The silver halide photographic emulsion of claim 10 which further contains a color-forming coupler.

19. A photographic light-sensitive material which comprises a support having applied thereon the silver halide photographic emulsion of claim 10.

* * * * *